US006421901B2

(12) United States Patent
Sitarski et al.

(10) Patent No.: US 6,421,901 B2
(45) Date of Patent: Jul. 23, 2002

(54) CONVERTIBLE SWING/HIGHCHAIR AND METHOD OF USE

(75) Inventors: Gerald P. Sitarski, Grand Island; Chinawut Paul Paesang, Hamburg, both of NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/825,871

(22) Filed: Apr. 5, 2001

Related U.S. Application Data

(62) Division of application No. 09/425,179, filed on Oct. 22, 1999.

(51) Int. Cl.[7] ..... B21K 21/16; A47C 13/00; A63G 9/16

(52) U.S. Cl. ..... 29/401.1; 297/130; 472/119

(58) Field of Search ..... 29/401.1; 297/281, 297/344.1, 130, 118, 217.1, 153; 472/118, 119; D6/339

(56) References Cited

U.S. PATENT DOCUMENTS

| | | | | |
|---|---|---|---|---|
| 137,121 | A | 3/1873 | Alcorn | |
| 785,201 | A | 3/1905 | Crandall | |
| 1,262,927 | A | 10/1918 | Paskal | |
| 1,439,619 | A | 12/1922 | Dziedzic | |
| 1,458,049 | A | 6/1923 | Grieshaber | |
| 2,525,377 | A | 10/1950 | Schwartz | 155/65 |
| 2,797,738 | A | 6/1957 | Patterson | 155/88 |
| D229,130 | S | 11/1973 | Foster | D6/10 |
| 3,806,117 | A | 4/1974 | Foster | 272/86 |
| D248,518 | S | 7/1978 | Huff | D6/10 |
| D250,861 | S | 1/1979 | Boudreau et al. | D6/10 |
| 4,150,820 | A | 4/1979 | Bochmann | 272/86 |
| 4,271,627 | A | 6/1981 | Echterling | 46/15 |
| 4,324,432 | A | 4/1982 | Eldon, III et al. | 297/377 |
| 4,325,578 | A | 4/1982 | Borucki | 297/281 |
| 4,415,200 | A | 11/1983 | Bourne | 297/174 |
| 4,452,446 | A | 6/1984 | Saint | 272/86 |
| 4,589,657 | A | 5/1986 | Saint | 272/85 |
| 4,697,845 | A | * 10/1987 | Kamman | |
| D293,046 | S | 12/1987 | Riehm | D6/347 |

(List continued on next page.)

FOREIGN PATENT DOCUMENTS

| | | | |
|---|---|---|---|
| GB | 1070921 | 6/1967 | S63G/9/16 |

OTHER PUBLICATIONS

Product Brochure: Graco® Advantage™1452ND Navy Dot and 1452MW Milky Way.

Product Brochure: Kolcraft® Lil'Swinger™ 14902–EJ, 1993.

*Primary Examiner*—David P. Bryant

(74) *Attorney, Agent, or Firm*—Morgan, Lewis & Bockius, LLP

(57) ABSTRACT

A child support device is disclosed that can be converted between a highchair configuration and a swing configuration. The support device includes a frame from which a U-shaped swing arm is rotatably mounted. A child seat is located on the U-shaped arm such that it can be slid between a distal position at the bottom of the U-shaped swing arm (swing configuration) and a proximal position at the upper ends of the U-shaped swing arm (highchair configuration). When in the highchair configuration, a swing lock can be provided to rotatably lock the U-shaped swing arm with respect to the frame such that the seat cannot swing. The swing lock can include a retractable post that can be extended to contact a portion of the frame to prevent rotation of the swing arm. An over rotation stop can also be provided to limit the angle of rotation through which the seat swings when in the swing configuration, and to work in conjunction with the retractable post to lock the swing arm in place when in the highchair configuration. A reversible softgoods device is also disclosed to provide padding for the child support. The softgoods device includes a first layer and second fluid resistant layer that can be selectively exposed from the child support device.

24 Claims, 24 Drawing Sheets

U.S. PATENT DOCUMENTS

| | | | | |
|---|---|---|---|---|
| 4,807,872 | A | | 2/1989 | Spilman et al. ..... 272/86 |
| 4,822,033 | A | | 4/1989 | Kohus et al. ..... 272/86 |
| D305,584 | S | | 1/1990 | Spilman et al. ..... D6/344 |
| 4,940,229 | A | | 7/1990 | Foster ..... 272/86 |
| 5,083,773 | A | | 1/1992 | Saint ..... 272/86 |
| 5,238,291 | A | | 8/1993 | Alionis ..... 297/118 |
| D348,157 | S | | 6/1994 | Amburgey et al. ..... D6/345 |
| 5,326,327 | A | | 7/1994 | Stephens et al. ..... 472/119 |
| D349,819 | S | | 8/1994 | Noll ..... D6/347 |
| D351,289 | S | | 10/1994 | Stephens et al. ..... D6/344 |
| D358,494 | S | | 5/1995 | Baerenwald et al. ..... D6/333 |
| 5,413,399 | A | | 5/1995 | Myers et al. ..... 297/118 |
| D368,816 | S | | 4/1996 | Mitchell et al. ..... D6/500 |
| 5,525,113 | A | | 6/1996 | Mitchell et al. ..... 472/119 |
| 5,533,936 | A | | 7/1996 | Julien et al. ..... 472/118 |
| D374,353 | S | | 10/1996 | Coleman ..... D6/333 |
| 5,593,207 | A | * | 1/1997 | Turner |
| 5,707,294 | A | | 1/1998 | Fischer ..... 472/118 |
| 5,769,727 | A | | 6/1998 | Fair et al. ..... 472/118 |
| 5,788,014 | A | | 8/1998 | Saint et al. ..... 185/43 |
| 5,791,999 | A | | 8/1998 | Lauro et al. ..... 472/118 |
| 5,951,102 | A | | 9/1999 | Poulson et al. ..... 297/130 |
| 5,975,631 | A | | 11/1999 | Fair et al. ..... 297/281 |
| 5,984,791 | A | | 11/1999 | Fair et al. ..... 472/118 |
| 6,001,021 | A | * | 12/1999 | Battaglia |
| 6,010,410 | A | | 1/2000 | Lauro et al. ..... 472/118 |
| 6,022,277 | A | | 2/2000 | Jankowski ..... 472/119 |
| 6,089,666 | A | * | 7/2000 | Rosko |

* cited by examiner

CONVERTIBLE SWING/HIGHCHAIR AND METHOD OF USE

This is a divisional of copending application Ser. No. 09/425,179 filed on Oct. 22, 1999.

FIELD OF THE INVENTION

The invention relates to a support device and its method of use, and more particularly, to a child's support device that is convertible between a highchair configuration and a swing configuration. The invention also relates to a reversible softgoods seat structure that can be placed within the support device to provide a cushioning surface for a child to rest on.

BACKGROUND OF THE INVENTION

Highchairs and swings are well known support devices that can be used for children. A conventional highchair includes a seat structure that is elevated from the floor by a support structure. Typically, the highchair includes a tray mechanism that is placed on top of the seat structure when a child is seated therein. The tray provides an eating surface for the child while also securing the child within the highchair seat structure.

A conventional child's swing includes a seat structure that has at least one arm extending upwardly from the seat structure and rotatably attached to a frame. The frame and arm suspend the seat above the floor such that the seat can rotate or swing with respect to the frame. The frame generally includes several metal or plastic bars that are fastened together to form a substantially symmetrical geometric configuration and evenly distribute the downward force from the seat and arm to the floor. In swing structures that include two arms extending from the seat, the two arms are often connected to a single bar that extends over the seat structure and is attached to two identically shaped triangular three-bar structures. The base portion of the triangular structures typically include bars extending between the triangular structures to further support the triangular structures and lock the distance between the triangular structures. The seat is free to rotate about the overhead bar and in between the triangular structures.

Recently, open top swings have become popular in which the overhead bar is replaced with hubs that are built into the top apex of each triangular side structure. An example of a conventional open top swing is disclosed in U.S. Pat. No. 5,525,113 to Mitchell et al. In the Mitchell open top swing, the hubs are each connected to an arm structure extending to each side of the seat such that the seat can rotate about a rotational axis of the hubs. The open top swing provides the benefit of free and clear access to the seat so that an adult can easily place a child into or remove a child from the seat without obstruction from an overhead bar.

In the past, there have been some attempts to combine some of the features of a highchair with that of a swing structure. For example, U.S. Pat. No. 5,238,291 to Alionis discloses a convertible highchair and swing apparatus. The invention includes two upstanding lateral support members 14 that are joined by upper and lower horizontal cross members 30 and 36 and a rear cross member 40. A chair member 60 is rotatably attached to the lateral support members 14 by a pair of fastening members 42, each of which extends into a boss member 26 on either of the support members 14. The chair member 60 includes a reversible hammock like seat structure 70 that extends between two cross members 64 and in between lateral support members 62. Conversion between the high chair mode and the swing mode is accomplished by flipping the chair member 60 over about the fastening members 42. The Alionis device provides no ability to adjust either the tray position or the seat position in either of the high chair and swing modes. In addition, the device can only be manually operated when in the swing mode. The swing range for the device is also limited by the length of the frame of the chair member. Ergonomic design of the seat structure is limited by the fact that the seat must be reversible and therefore designed as a hammock type of seat. Finally, an upper cross member 32 located above the seat and extending between the lateral support members prevents quick and easy access to a child seated in the device when in the swing mode.

Another example of a device that can be arranged in both a high chair mode and a swing mode is disclosed in U.S. Pat. No. 5,413,399 to Myers. Conversion between modes is accomplished by complete removal and reattachment of the seat from a frame structure. When switching from the high chair mode to the swing mode, the first step includes removing the seat member 50 from its seated high chair position secured atop a frame structure 12. Second, the seat is reattached to the frame 12 by rotating a portion of the tray structure (handle member 90) to extend vertically above the seat, and hanging the seat from the frame via dowel members 99 located on the handle member 90. The device disclosed by Myers requires the use of a large tray structure that is not adjustable and results in miscellaneous non-functional structures being present when in the high chair mode. In addition, the device can only be manually operated when in the swing mode. The device also does not permit adjustment of seat position in either of the swing or high chair modes and does not permit easy access to a child located in the seat when in the swing mode.

SUMMARY OF THE INVENTION

The drawbacks of the prior art are overcome by the present invention, which provides a child support device that can be quickly and easily converted between a highchair configuration and; preferably, an open top swing configuration: The device can include an ergonomically designed seat that is adjustable in either of the highchair and swing configurations. The seat can be automatically operated (swung) when in the swing configuration. An adjustable highchair tray and swing tray for use in the highchair and swing configurations, respectively, can also be provided. The invention combines the advantages of the motorized open top swing, e.g., quick and easy access to the child located in the swing seat, easy assembly and automatic operation, with the ability to convert the device to an adjustable highchair configuration.

The process of converting the device between the highchair configuration and swing configuration is also relatively simple. Specifically, conversion can be accomplished by unlocking the seat structure from a first configuration and sliding the seat along a slide arm to the second configuration. A position lock that can include multiple button locks located on the swing arm permits the seat structure to be quickly and easily adjusted along the swing arm between configurations and also allows the seat to be located at a number of height positions in the highchair configuration. Other types of locks can be built into the frame, swing arm and seat to provide the adjustability necessary to switch between the high configuration and the swing configuration. In particular, a swing lock can be provided to prevent the seat and swing arm from rotating with respect to the frame when in the high chair configuration, a high chair support rotation lock can be provided to lock the angular seat positions with respect to the swing arm when the device is in the high chair configuration, and a swing support rotation lock can be provided to lock the seat at a predetermined angle with respect to the swing arm when in the swing configuration.

The invention also includes a reversible softgoods device for placement in the seat of the convertible swing/highchair device. The reversible softgoods device is shaped to fit within the seat of the swing/highchair device and functions to provide comfort and padding to a child resting in the device. When in the high chair mode, the softgoods device has the dual function of providing comfort and resisting absorption of food, drink and other solid and liquids that may be spilled or otherwise released while the child is seated in the high chair configuration.

DESCRIPTION OF THE PREFERRED EMBODIMENT

A convertible swing/highchair device and method of use embodying the principles of the invention is illustrated in FIGS. 1–25 and described below.

Figure 1:
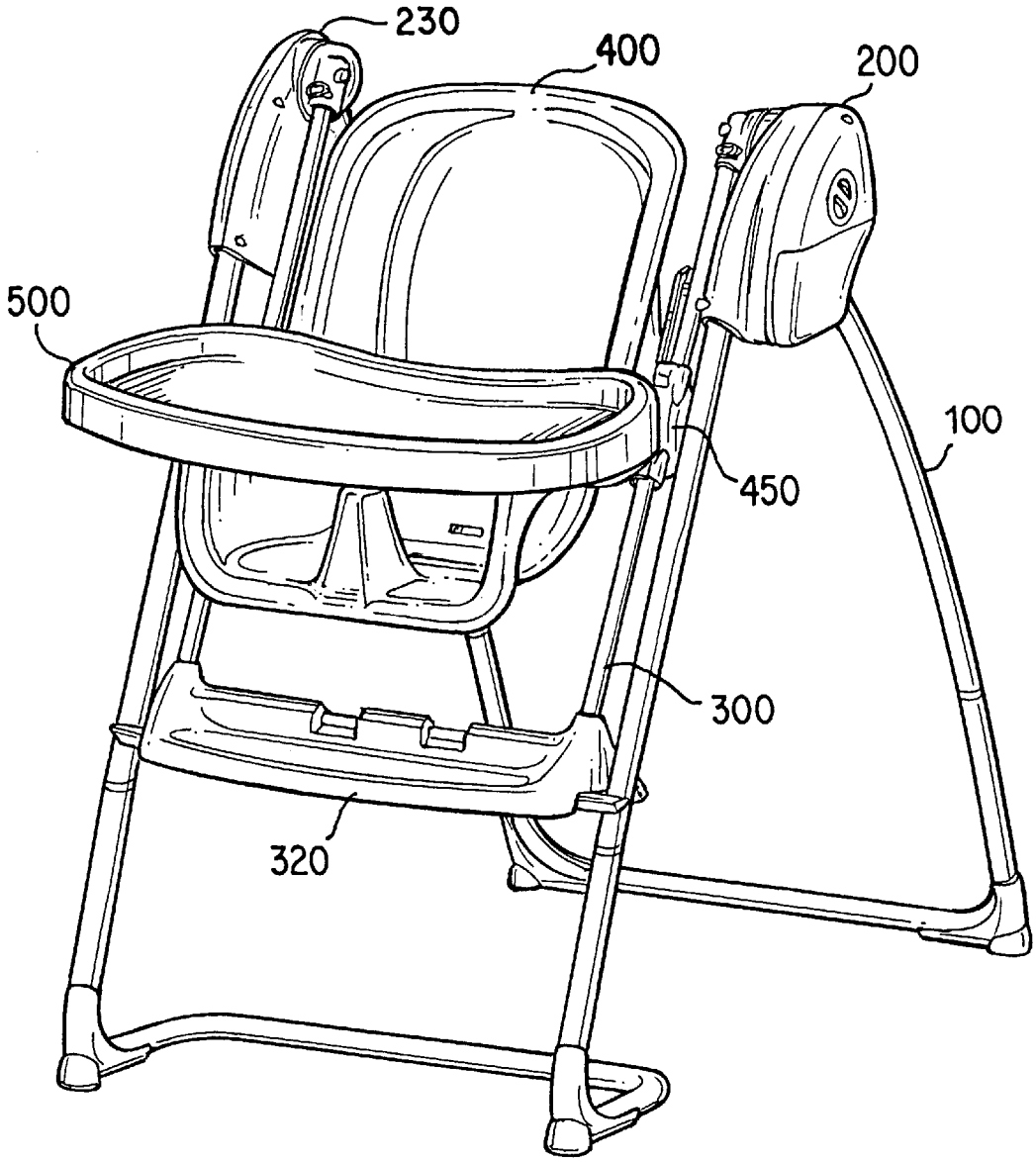
FIG. 1 is a perspective view of a child support device made in accordance with the principles of the invention and in the high chair configuration.

FIG. 1 illustrates the swing/highchair device 1 in its highchair configuration. The device includes an open top type of frame 100 from which a child support structure can be suspended via a swing arm 300. The child support structure can be configured as an ergonomic child's seat 400 and can include a highchair tray 500 adjustably and removably mounted to the seat 400 to provide an eating or playing surface for the child. In the highchair configuration, the seat is positionally and rotationally locked to the swing arm 300. The swing arm 300 is also positionally and rotationally locked to the frame 100 when in the highchair configuration and can include a footrest 324. Conversion to the swing configuration can be accomplished by sliding the seat 400 along the swing arm 300 to a lowermost position and rotating the seat 400 with respect to the swing arm 300 to a desired angular orientation. Several locking, adjusting and pivoting mechanisms can be used to facilitate this conversion of the swing/highchair device, and are described below.

Figure 2:
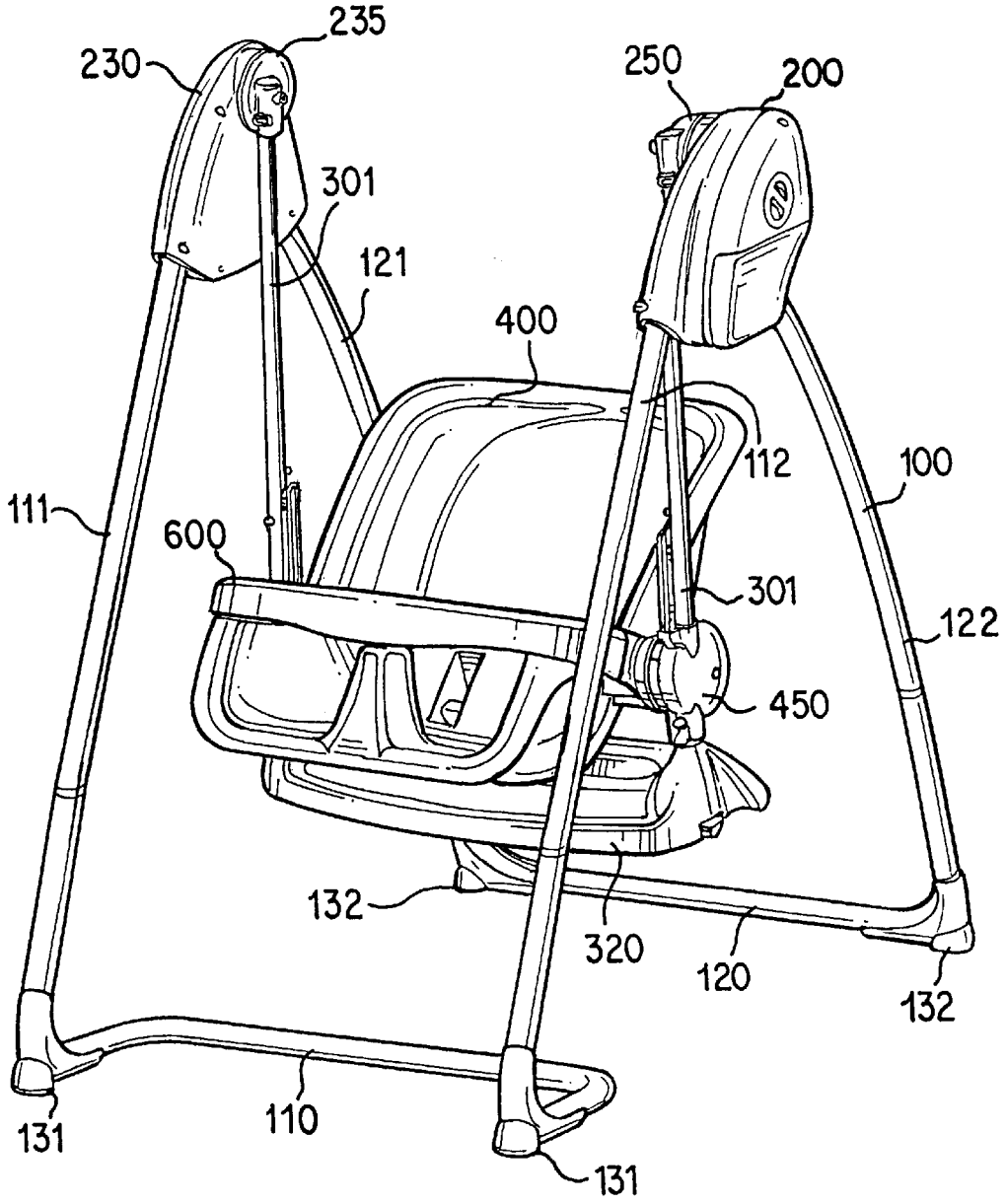
FIG. 2 is a perspective view of the child support device shown in FIG. 1 in the swing configuration.
Figure 10:
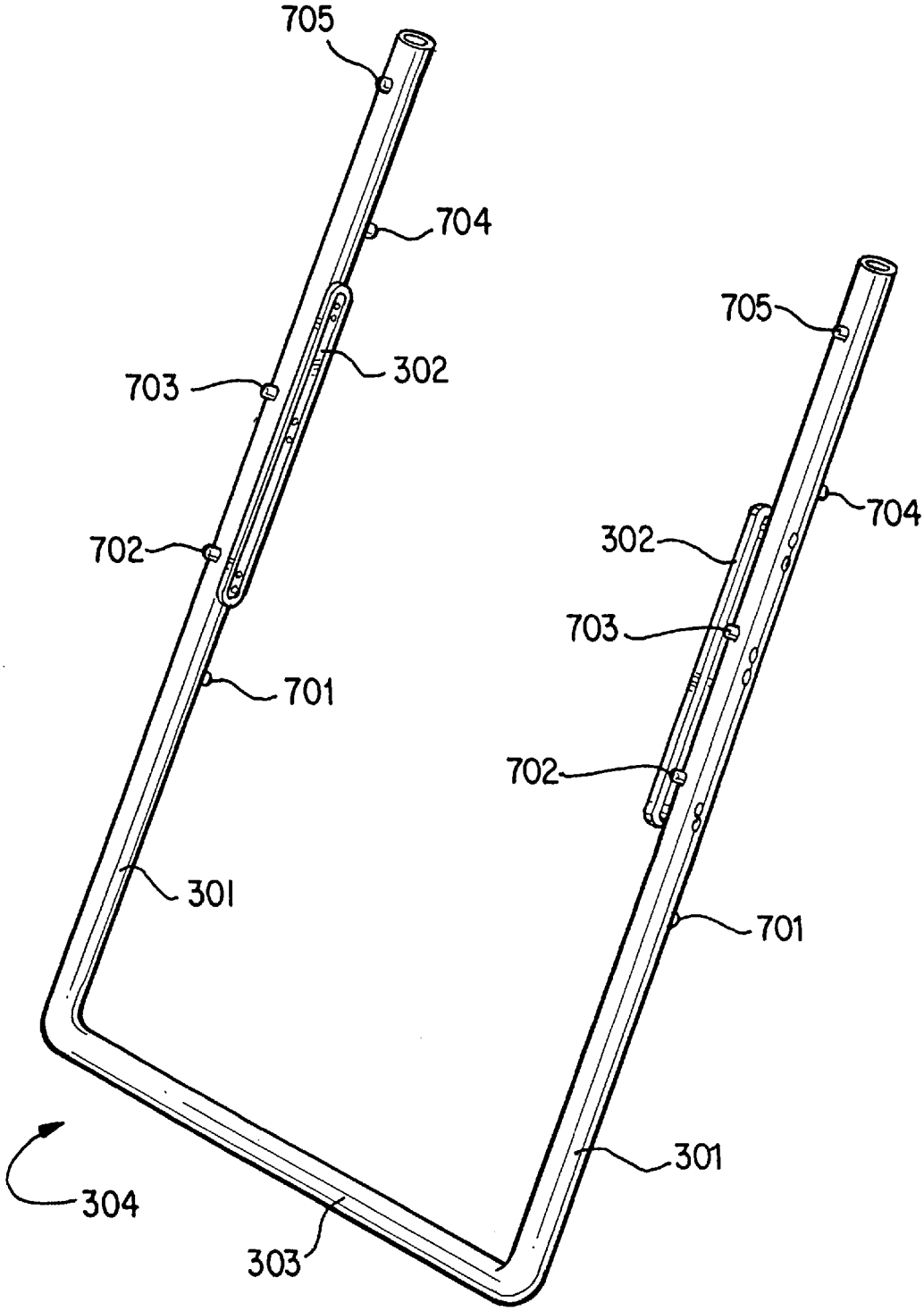
FIG. 10 is a perspective view of the swing arm tube of the child support device shown in FIG. 1.
Figure 11:
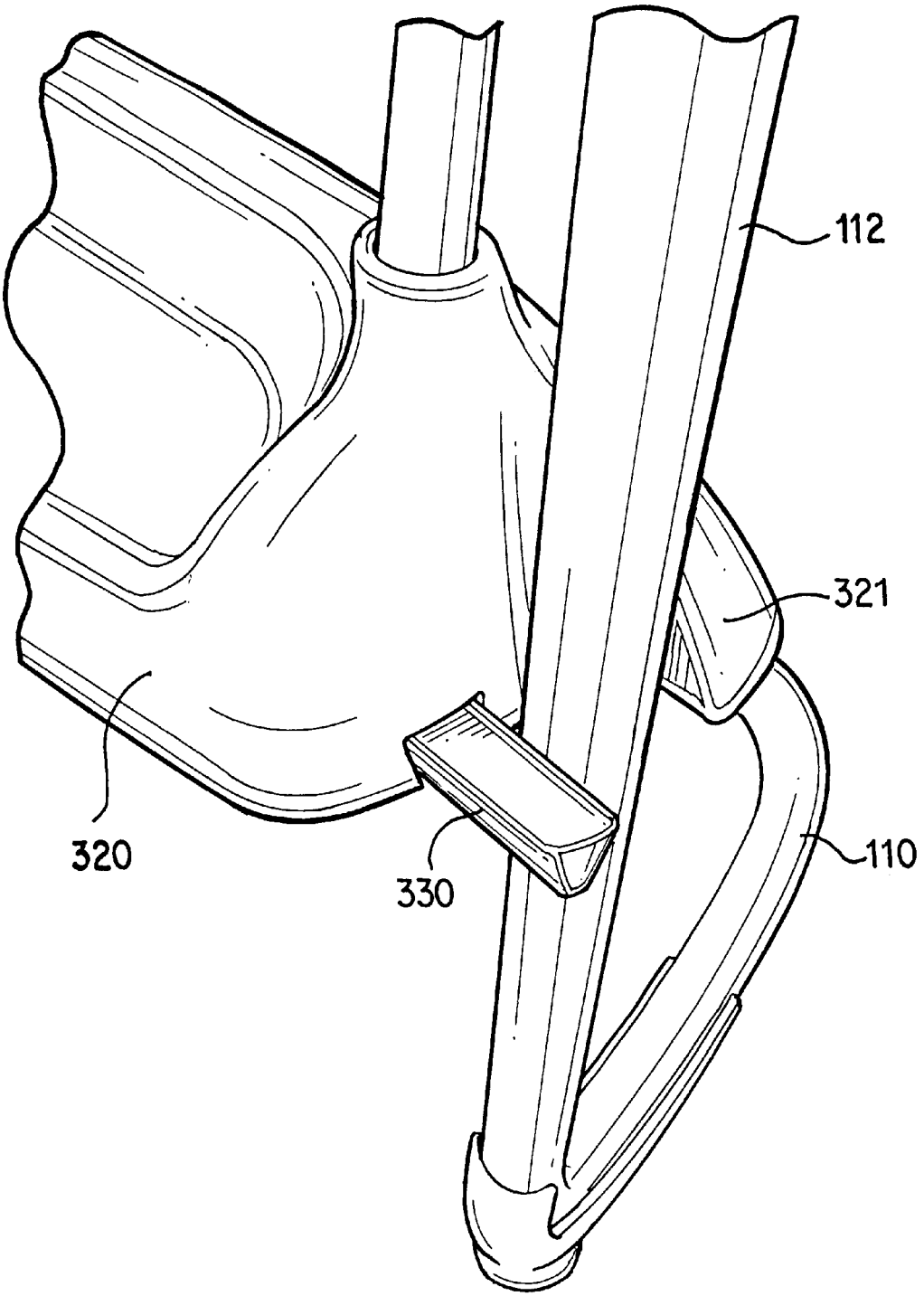
FIG. 11 is an isolated perspective view of the swing lock of the child support device shown in FIG. 1.
Figure 12:
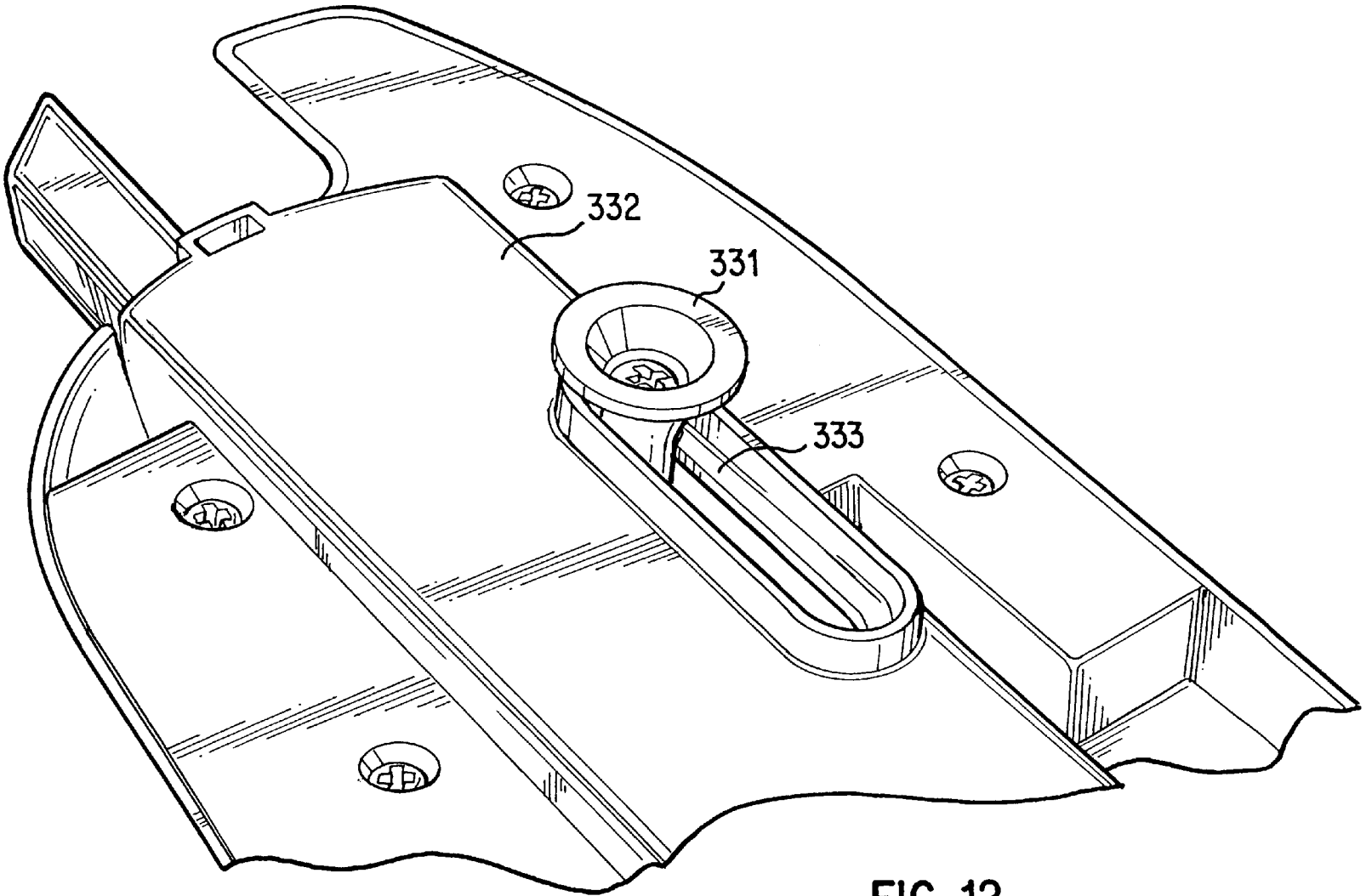
FIG. 12 is an isolated perspective view of the swing lock of the child support device shown in FIG. 1.
Figure 13:
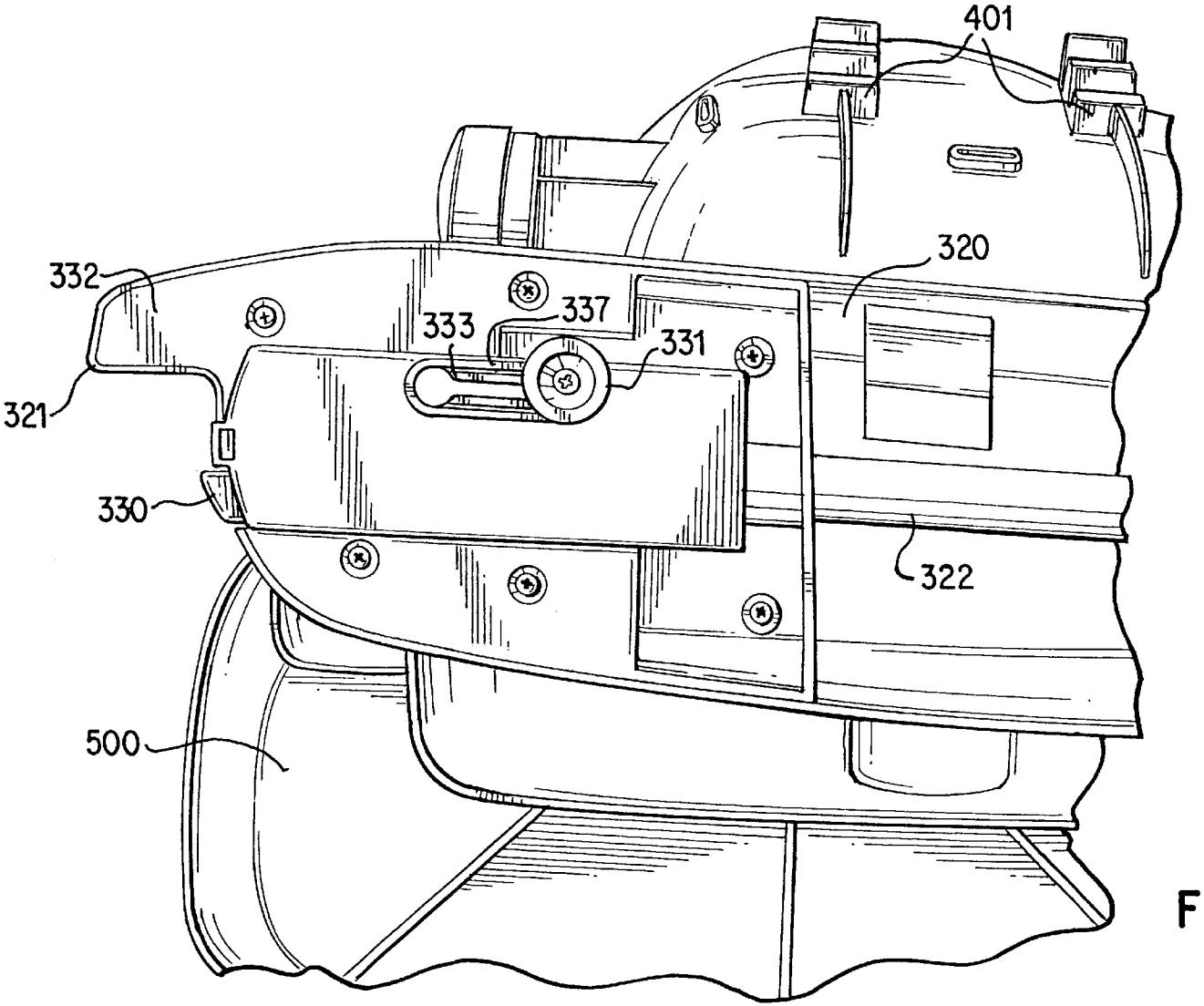
FIG. 13 is an isolated perspective view of the swing lock of the child support device shown in FIG. 1.
Figure 14:
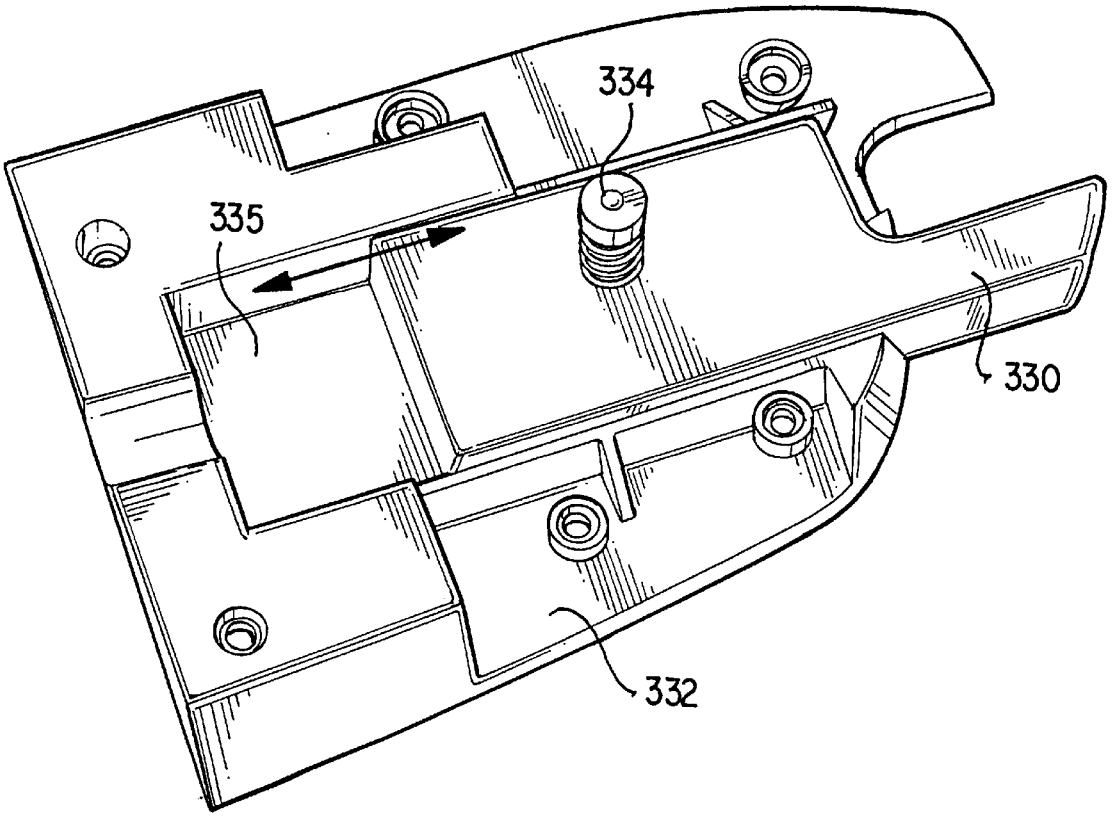
FIG. 14 is a perspective view of the swing lock of the child support device shown in FIG. 1.
Figure 15:
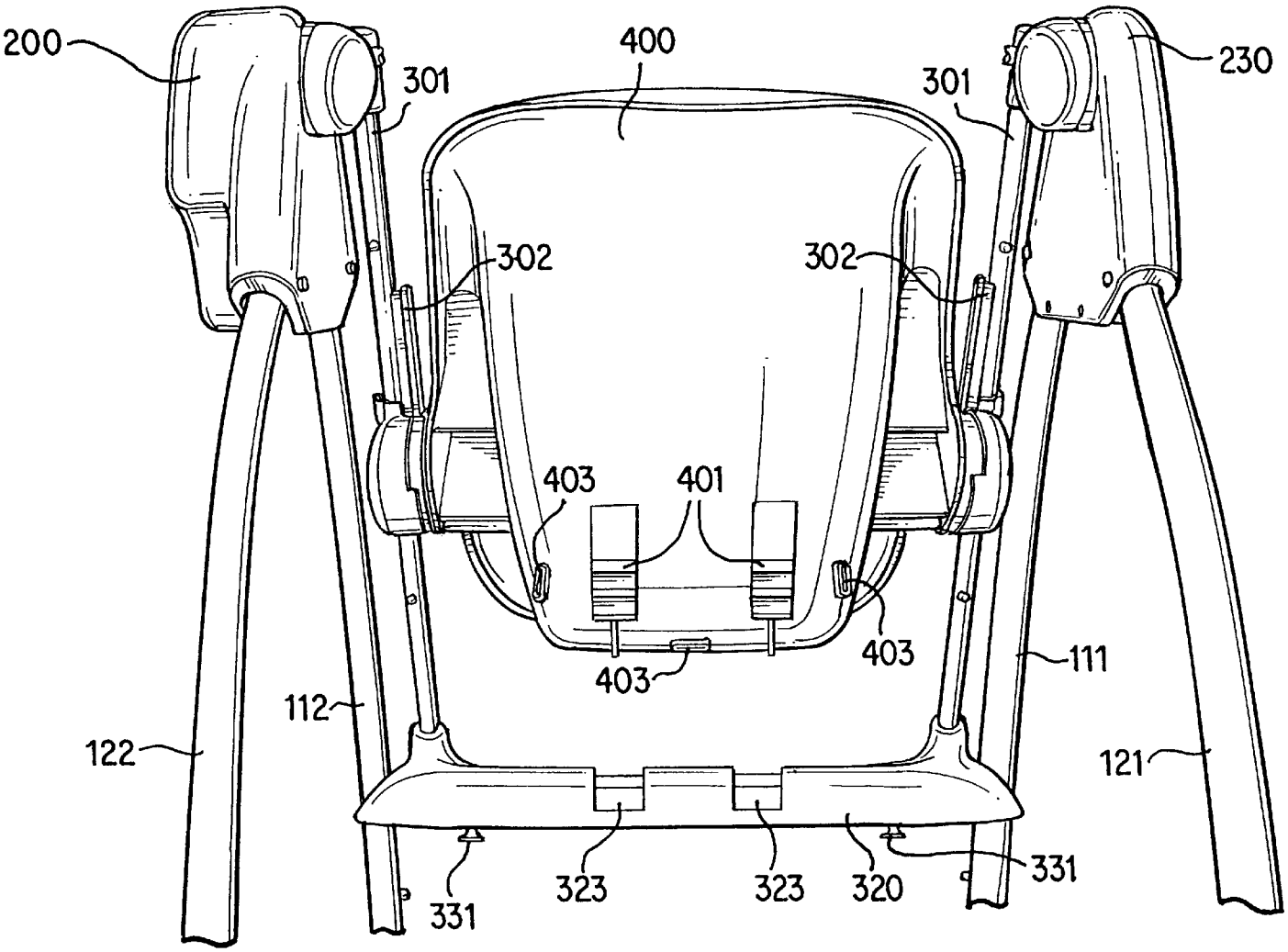
FIG. 15 is a rear view of the child support device shown in FIG. 1.
Figure 16:
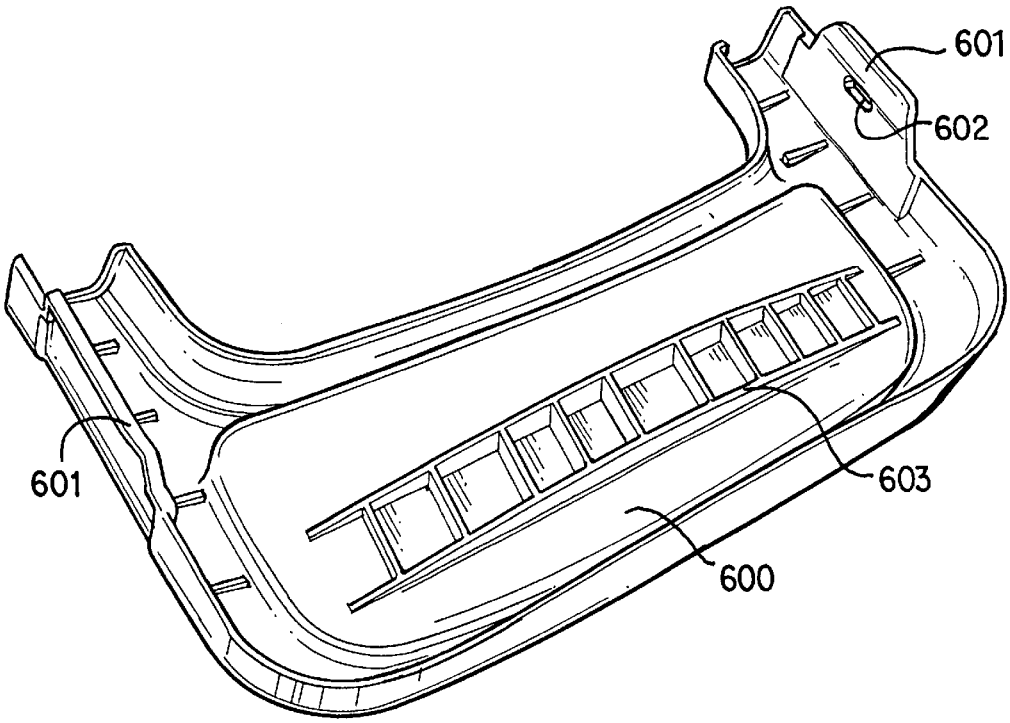
FIG. 16 is a perspective view of the swing tray for the child support device shown in FIG. 1.
Figure 19:
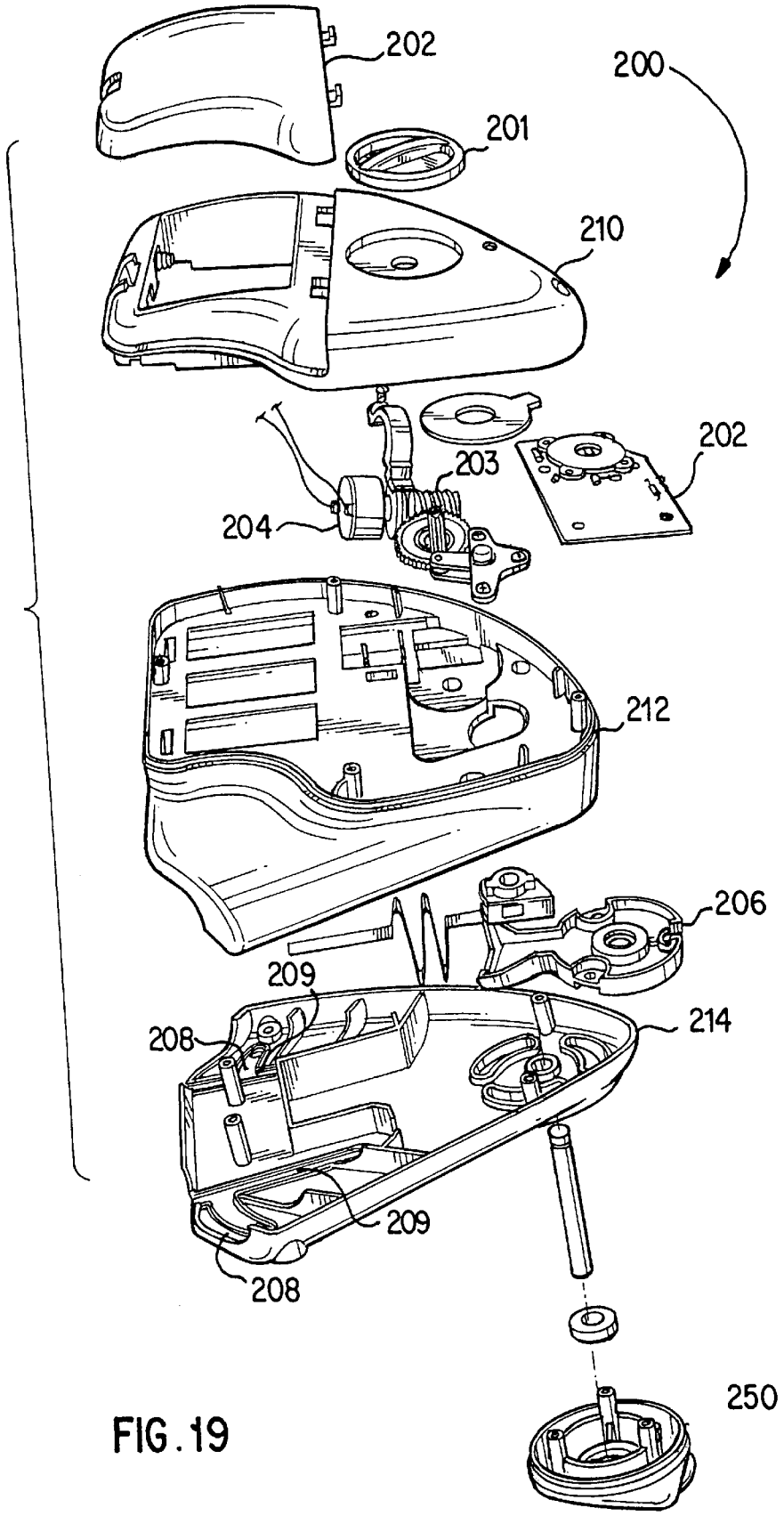
FIG. 19 is an exploded view of the upper frame joint with motor for the child support device shown in FIG. 1.

In the swing configuration as illustrated in FIG. 2, the seat 400 is positioned at a lower end of the swing arm 300 and is rotationally adjustable relative to the swing arm 300. The swing arm 300 can be constructed of a U-shaped tubular member 304 that includes two vertical arms 301 and a horizontal arm 303 (as shown in FIG. 10). The end of each vertical arm is secured via a button lock 700 to pivot hubs 250 located on upper frame joints 200 of the frame 100. The pivot hubs 250 can rotate with respect to the frame 100 and thus allow the swing arm 300 and seat 400 to swing relative to the frame 100. A motor can be located in one of the upper frame joints 200 to automate the swinging motion of the swing arm 300 and seat 400. Batteries can also be stored within the frame joint 200 behind a battery cover plate 202, and the speed of the motor can be controlled by a control knob 201 located on the frame joint 200, as best seen in FIG. 19.

The frame 100 of the swing/highchair device can be constructed from a number of tubular members that are secured together via button locks 700. A button lock 700, such as those sold under the trademark "VALCO", includes a rounded, button shaped piece that is biased towards and extends through a hole located in a first tube member. A second tube member can be attached to the first tube member by depressing the button shaped piece into the first tube member and sliding a large outer portion of the second tube member over the first tube member. When a hole located in the second tube member aligns with the button shaped piece, the piece springs out and extends through the hole in each of the first and second tube members to lock the tube members together. The tubes can be released by depressing the button shaped piece back into the first tube and pulling the tubes apart.

As shown in FIG. 2, the frame 100 preferably includes a front lower tube 110 that is attached to a front left upper tube 111 and front right upper tube 112 via button locks 700. A rear lower tube 120 is connected to a rear left upper tube 121 and-a rear right upper tube 122 via button locks 700. The front and rear tubes angle towards each other and are connected to each other by upper frame joints 200 and 230 to form an open top frame configuration. Front and rear ground stays 131 and 132, respectively, can be attached to corners of the front and rear lower tubes to protect the frame and prevent the swing/highchair device from sliding on the floor.

Figure 3:
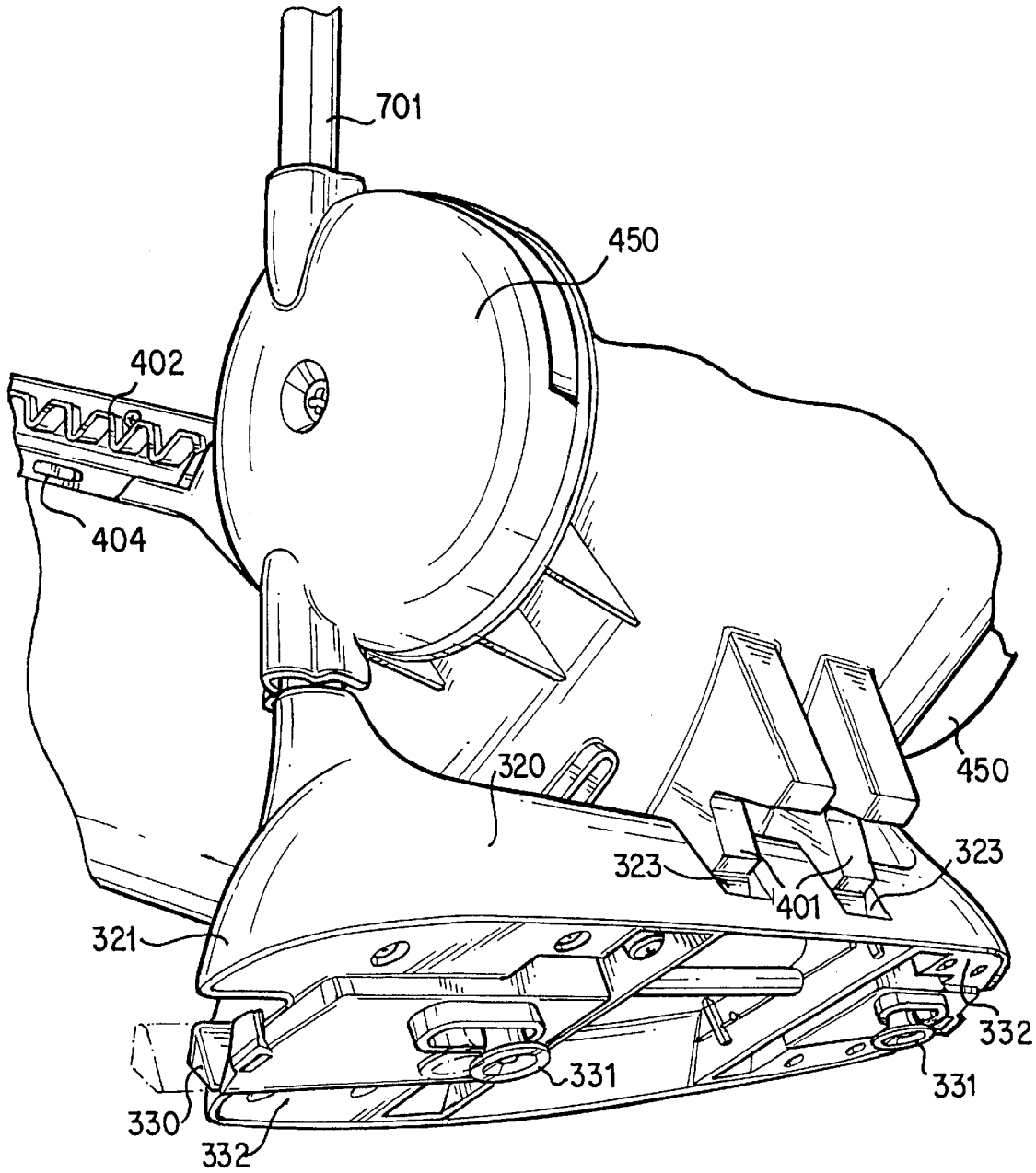
FIG. 3 is an isolated perspective view of the swing arm of the child support device shown in FIG. 1.
Figure 4:
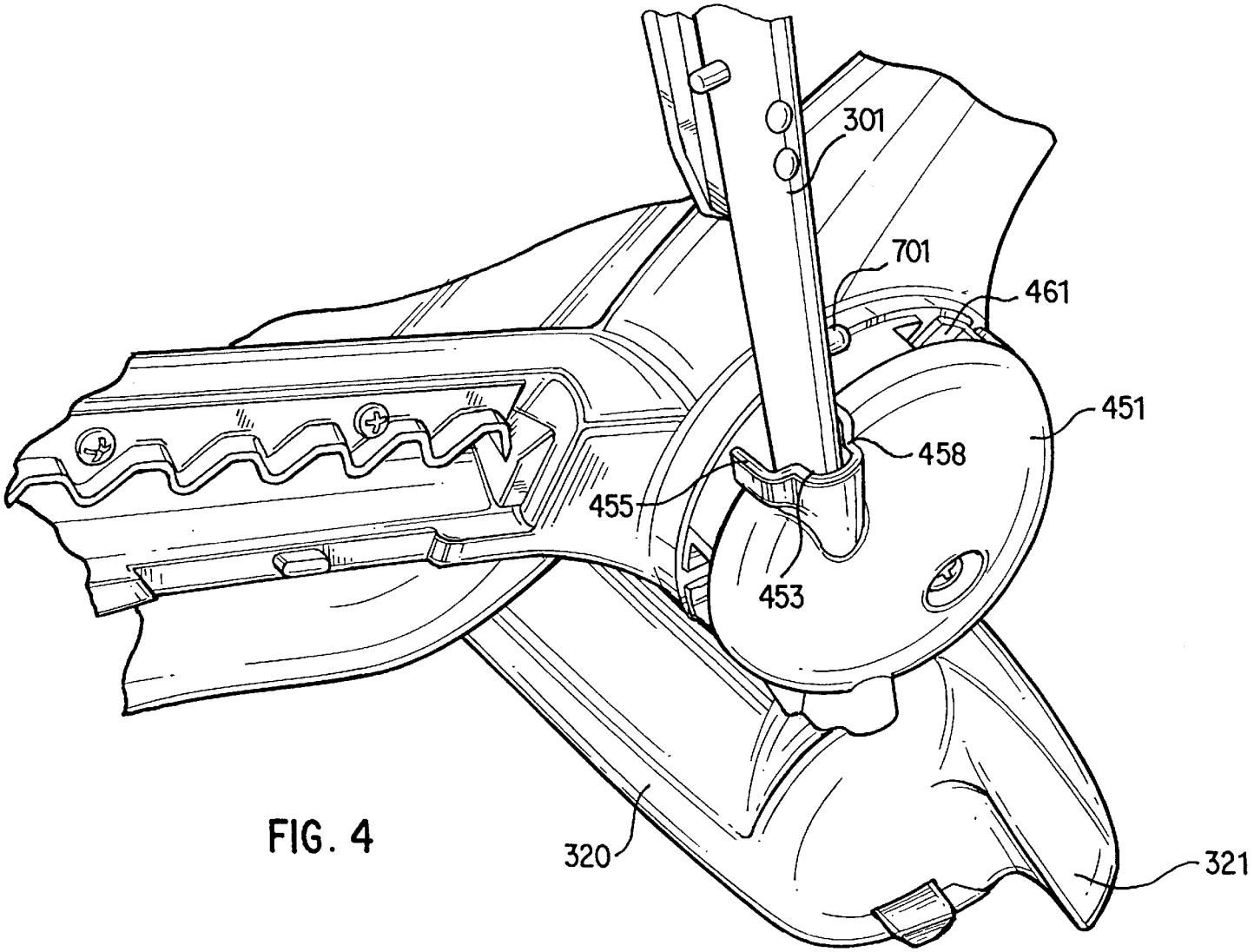
FIG. 4 is an isolated perspective view of the support pivot of the child support device shown in FIG. 1.

As shown in FIG. 3, the seat 400 can be rotationally adjustable with respect to the swing arm 300 when in the swing configuration. A number of different rotational orientations can be achieved by aligning one of a number of notches 401 formed in the rear of the seat structure 400 with a mating surface 323 provided on the footrest 324. The weight of the seat 400 and/or child keep the notches 401 in contact with the mating surfaces 323 to maintain the rotational position of the seat 400 with respect to the swing arm 300 during use. Button locks 701 located on the swing arm 300 prevent the seat from moving away from its lower position on the swing arm when in the swing configuration. In addition, overrotation stops 321 provided on either side of the footrest 320 prevent the swing arm 300 and seat 400 from rotating past either of the front upper frame members 111 and 112 or the rear upper frame members 221 and 222. Thus, the swing arm and seat are designed to have an angular rotation confined within the frame 100.

As shown in FIGS. 4–8, the seat 400 includes symmetrical left and right pivots 450 that connect either side of the seat to the vertical arms 301 of the swing arm 300. Each pivot 450 includes a cap 451 that is rotatably connected to a pivot base 410 on the seat 400 as shown by arrow A in FIG. 8. A swing arm throughway 453 is provided in the cap 451 and is configured to allow a vertical arm 301 to be slid between the pivot base 410 and the swing arm throughway 453. A ramped flange 455 located at three of the four exterior comers of the throughway 453 allows the pivot cap to pass over a button lock without interruption or locking. The fourth exterior comer is not flanged and includes a stop surface 458 that is configured to abut against a button lock 701 to keep the seat 400 in its lowermost position when in the swing configuration. The pivot cap 451 can also include a rotation limit 457 molded into the inner surface of the cap 451. The rotation limit 457 rides along a circular guide portion 411 of the pivot base 410 and can contact a stop structure 412 to limit the amount of rotation permitted between the seat 400 and the swing arm 300.

Figure 8:
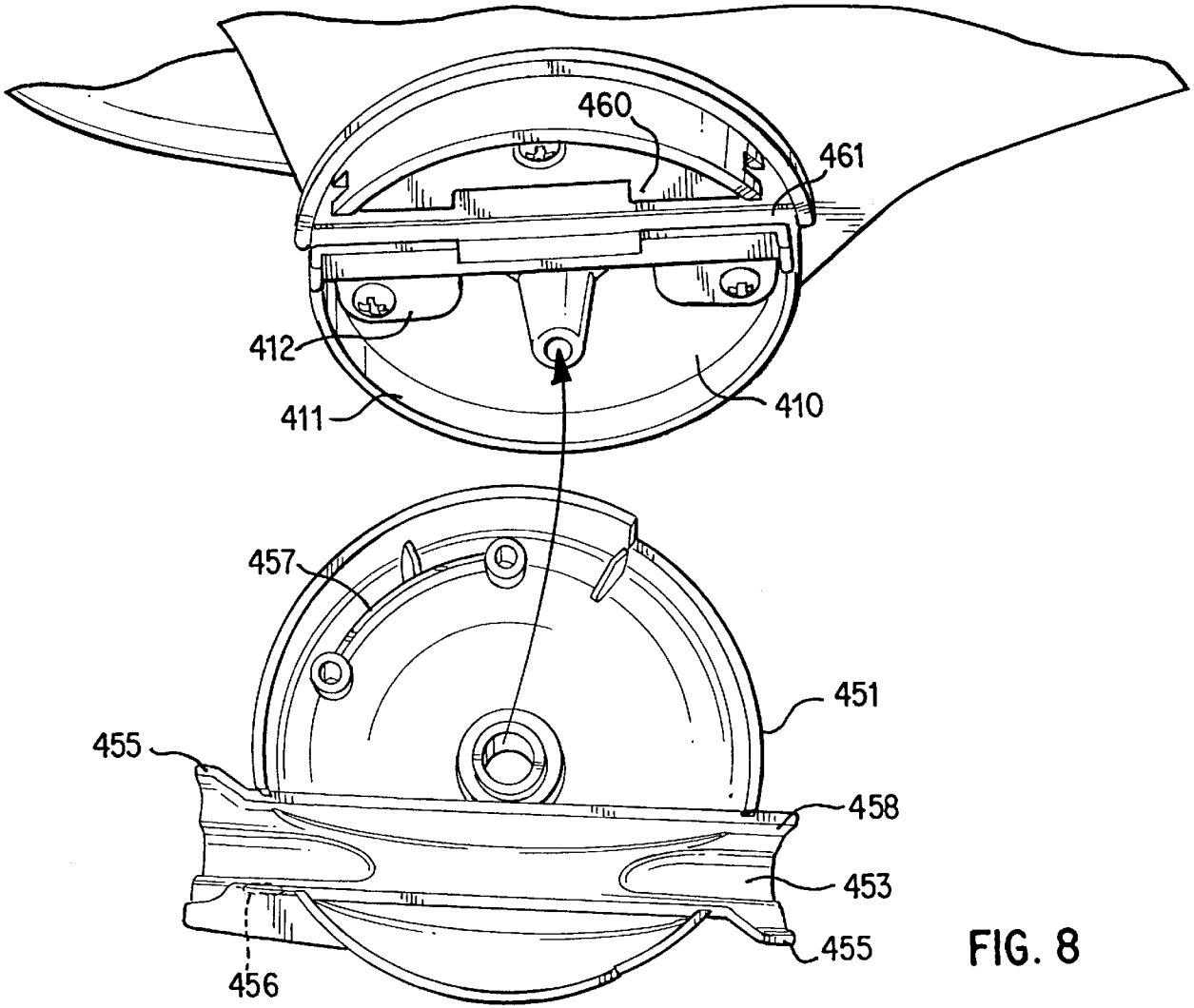
FIG. 8 is an exploded view of the support pivot of the child support device shown in FIG. 1.

A button opening 456 as shown in FIG. 8 located in the pivot cap 451 can be used to lock the pivot 450 and seat 400 at a particular location along the length of the swing arm 300. Specifically, the vertical arms 301 of the swing arm 300 include two button locks 702 and 703 that can cooperate with button opening 456 in each of the pivot caps 451. Button lock 702 is located at a lower position than button lock 703 and is deigned for use in a lower high chair mode. Button lock 703 is located higher than button lock 702 and is designed for use in a normal (upper) high chair mode. Any number of additional button locks could be provided on the swing arm 300 to allow use of the swing/highchair device in a greater variety of high chair modes.

Figure 9A:
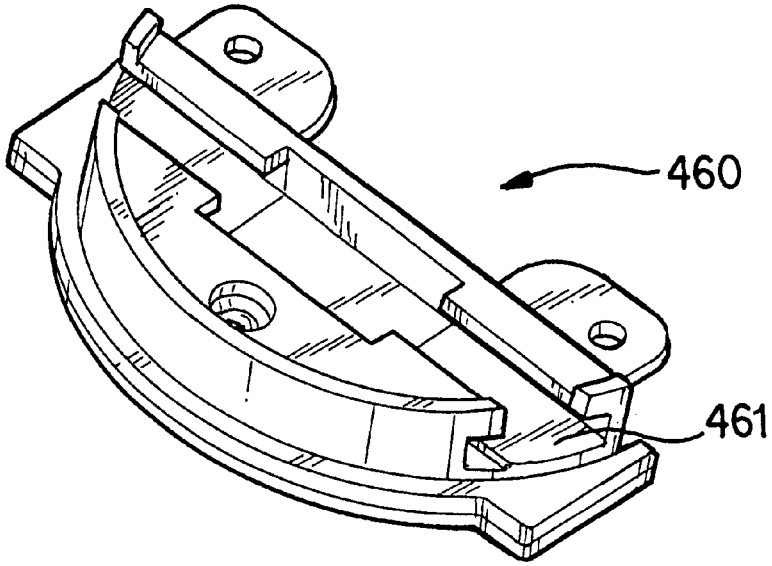
FIGS. 9A–B are perspective views of the key portion for the child support device shown in FIG. 1.
Figure 9B:
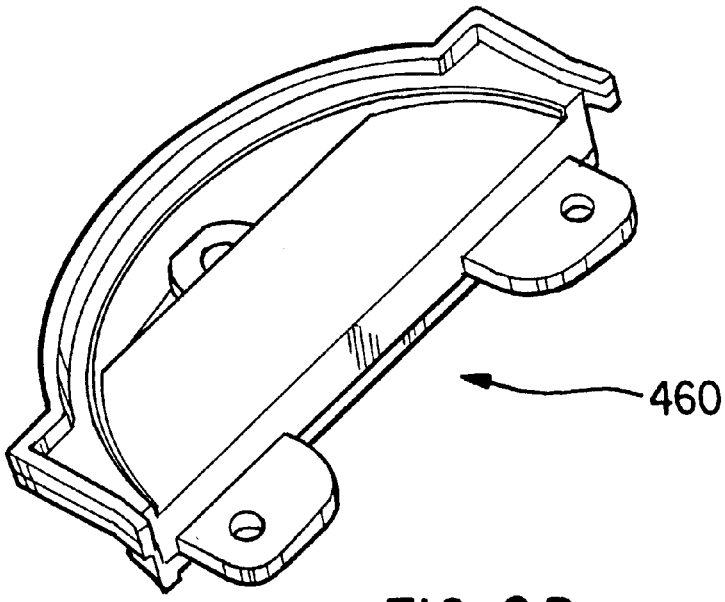

The pivot 450 also includes a keyway 461 that is defined by a key portion 460 (as best shown in FIGS. 9A–B). Key portion 460 is a semicircular structure that is positionally and rotationally fixed on the pivot base 410 and sandwiched between the pivot cap 451 and pivot base 410. The keyway 461 acts in conjunction with a rail 302, best seen in FIG. 10, located on each of the vertical arms 301 on the swing arm 300. Only when the seat 400 is rotated to a position at which the keyway 461 is aligned with the rail 302 can the seat 400 be moved vertically up the slide arm 300. In addition, a user must depress button lock 701 to permit upward movement of the seat 400.

A button lock 704 can also be provided at an upper location on the vertical arms 301 to contact the stop surface 458 and prevent the seat from being lifted up and off the top extent of the rail 302. Accordingly, once the rail 302 is mated into the keyway 461, the seat 400 is locked at a particular angular orientation with respect to the swing arm 300 during its entire upward movement towards the highchair configuration.

As shown in FIG. 10, several button locks are positioned about the U-shaped tubular member 304 to provide adjustment and locking ability. Button locks 701 prevent the seat 400 from lifting off of the footrest 320 when the device is in the swing configuration. Button locks 702 cooperate with button opening 456 on the pivot cap to lock the seat 400 at a lower high chair position. Similarly, button locks 703 lock the seat 400 in an upper high chair position. Button locks 704 prevent the seat 400 from lifting up and off the rail 302. Finally, button lock 705 secures the swing arm 300 to each of the pivot hubs 250 on the upper frame joints 200.

Once the seat 400 has been slid upward along the slide arm 300 and one of the button locks 702 or 704 has engaged the button opening 456 in the pivot cap, the swing arm 300 should then be rotationally locked with respect to the frame 100 to complete the conversion from the swing configuration to the highchair configuration.

FIGS. 11–14 illustrate a preferred swing lock for locking the swing arm 300 with respect to the frame 100. A retractable post 330 is located within the footrest 320 and can be selectively extended and retracted. When extended, the retractable post 330 acts in conjunction with the overrotation stop 321 of the footrest 320 to sandwich and secure one of the front upper frames 111 or 112 therebetween. A post lock 331 located on the bottom of the footrest 320 and extending through a channel 337 in the post cover 322 operates to lock the retractable post 330 in its extended locked position. The post lock 331 is attached to the retractable post 330 such that they both move together when post lock 331 is slid in channel 337. When the post lock 331 is located at a position that corresponds to the extended position for the retractable post 330, post lock 331 snaps into lock notch 333 by action of the post lock spring 334. Thus, the post lock 331 and retractable post 330 are locked in the extended position. To unlock and retract the retractable post 330, a user must pull the post lock 331 in a direction away from the footrest such that the post lock 331 can clear the lip of the lock notch 333 and then be slid to a retracted position.

The seat 400 can include a padding layer attached or formed onto its surface for comfort. The seat 400 can also include beltways 403 for insertion of a safety strap to further secure a child within the seat 400. A highchair tray 500 and a swing tray 600 can be attached to the seat 400 to provide a playing and eating surface for a child when the device is in either the highchair configuration or swing configuration, respectively.

Figure 5:
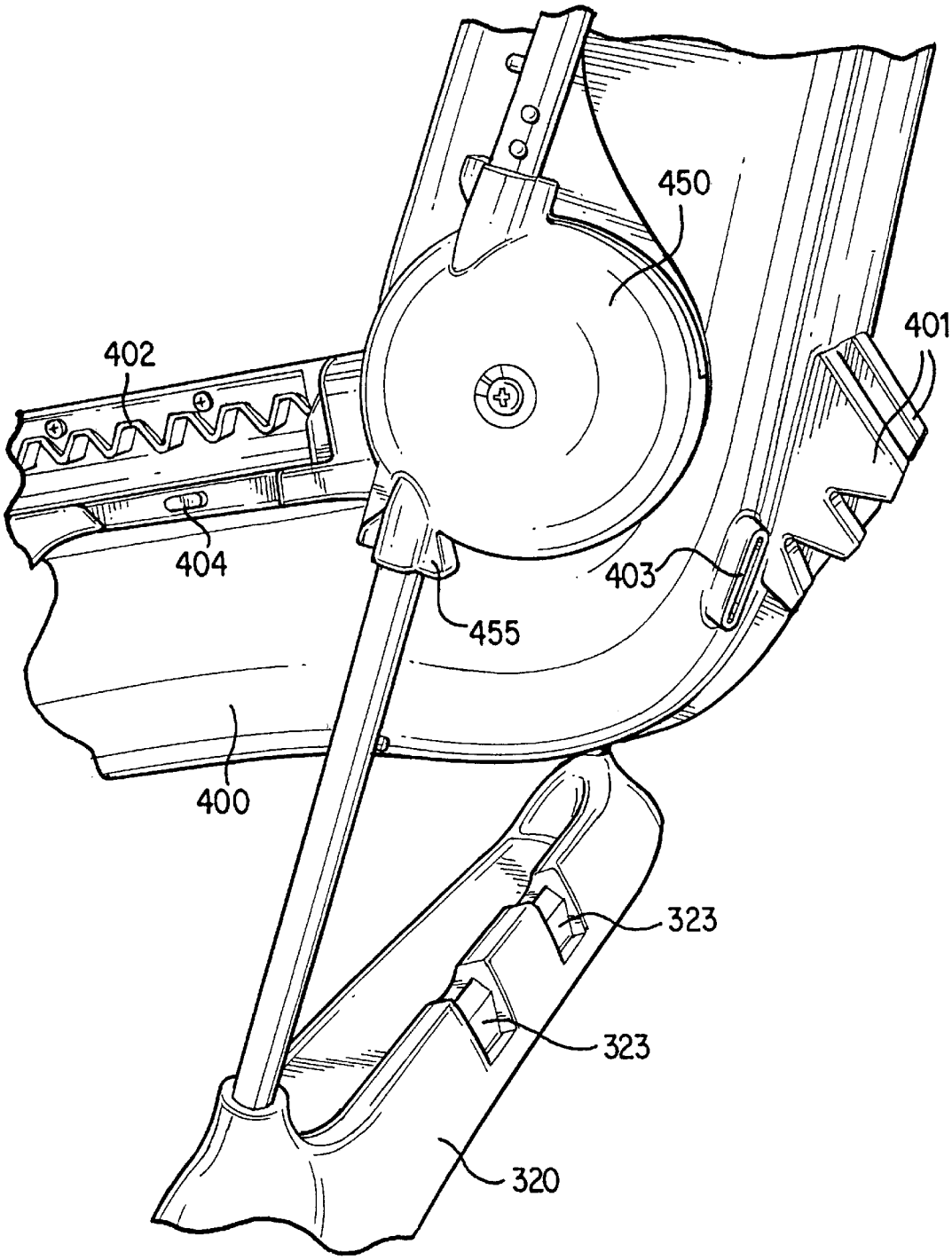
FIG. 5 is an isolated perspective view of the swing arm and support structure of the child support device shown in FIG. 1.
Figure 6:
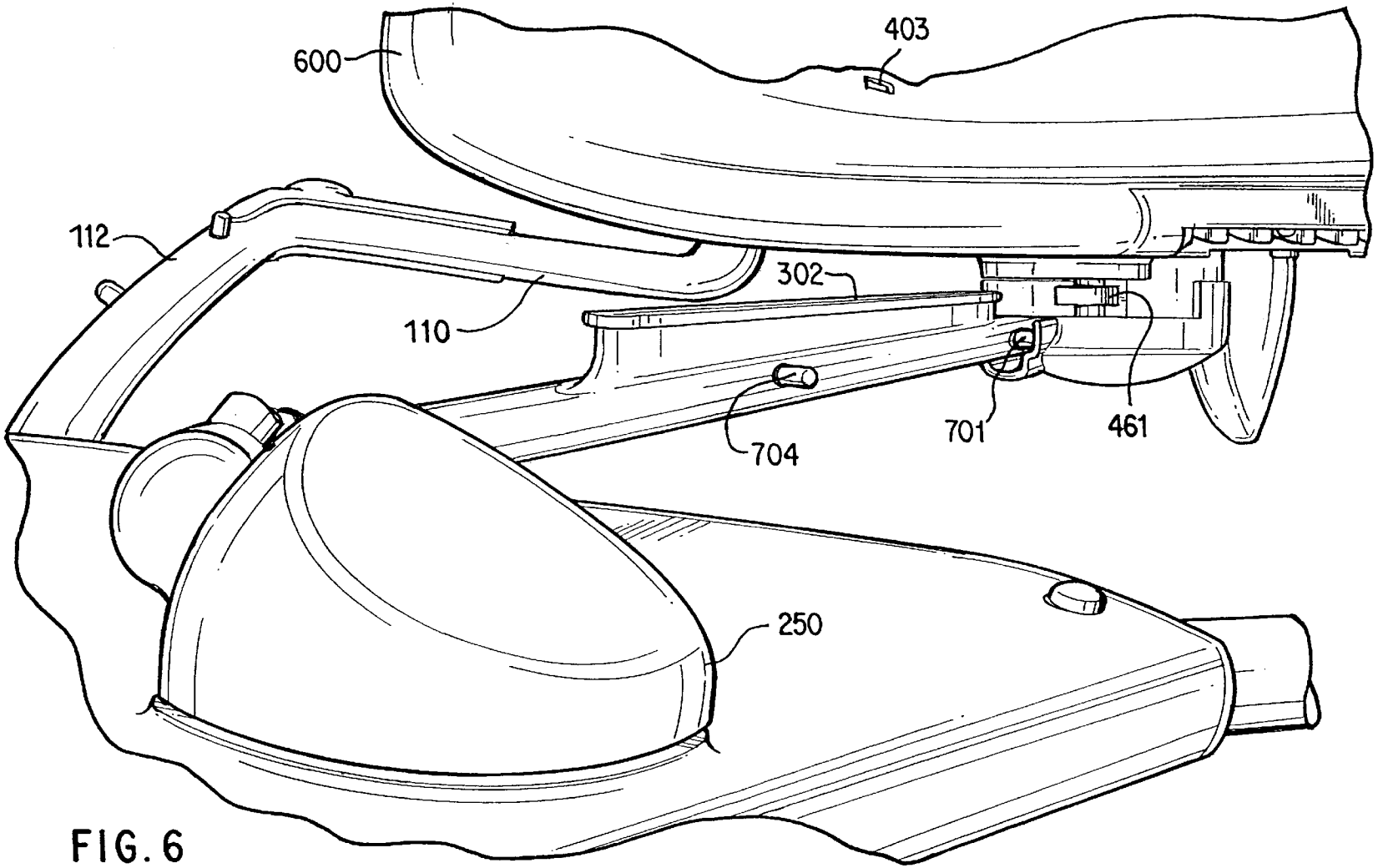
FIG. 6 is an isolated perspective view of the swing arm and support structure of the child support device shown in FIG. 1.
Figure 7:
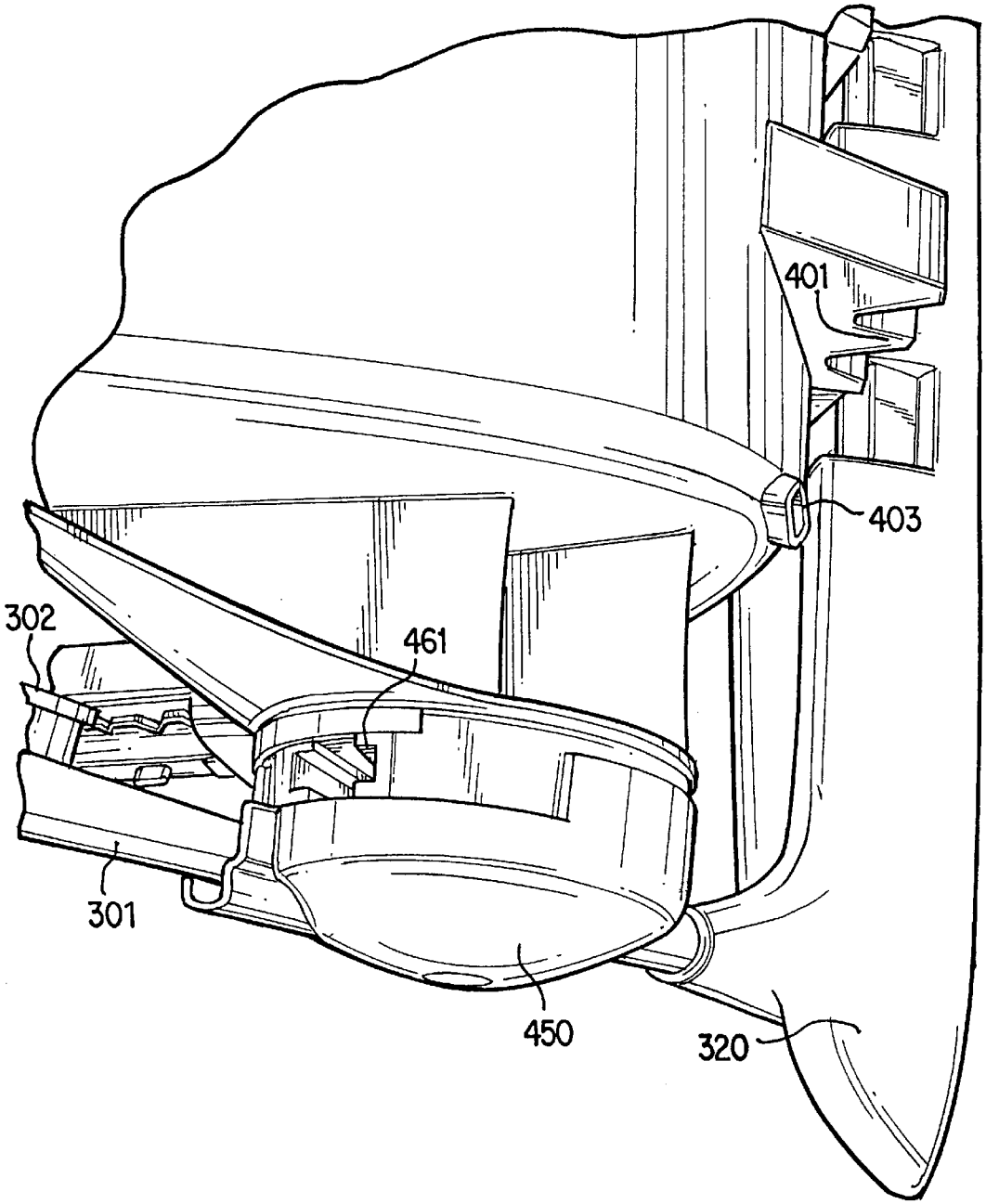
FIG. 7 is an isolated perspective view of the swing arm and support structure of the child support device shown in FIG. 1.
Figure 17:
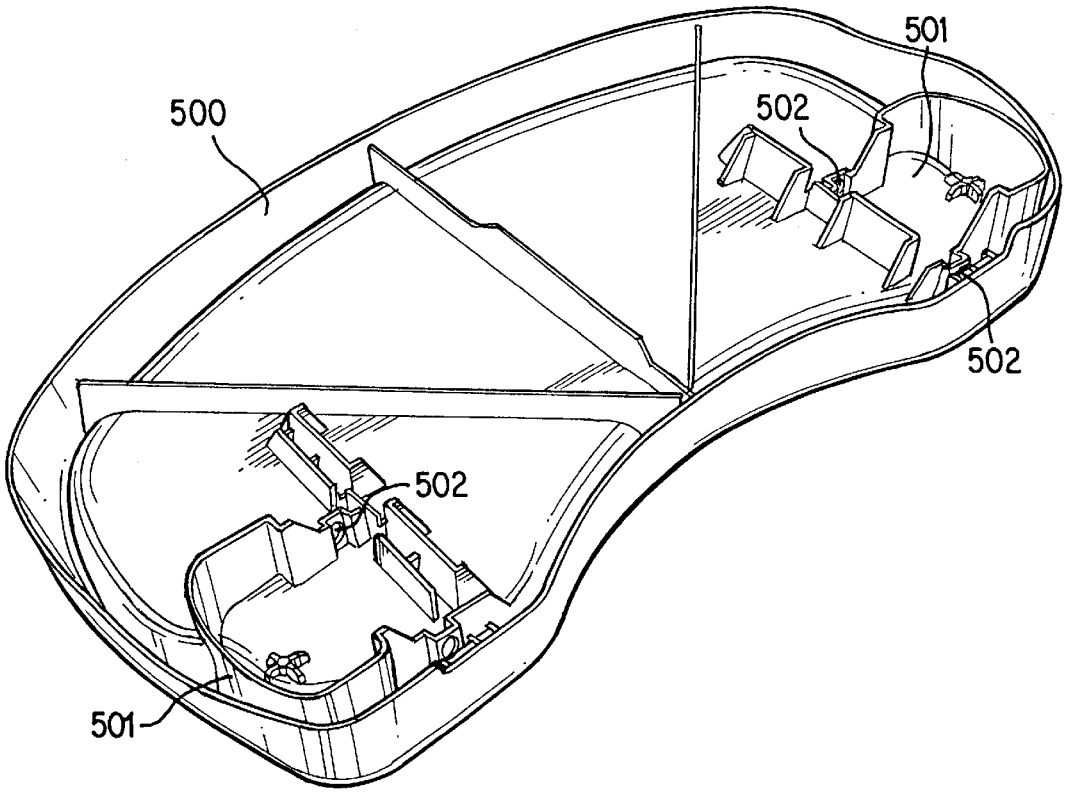
FIG. 17 is a perspective view of the highchair tray of the child support device shown in FIG. 1.
Figure 18A:
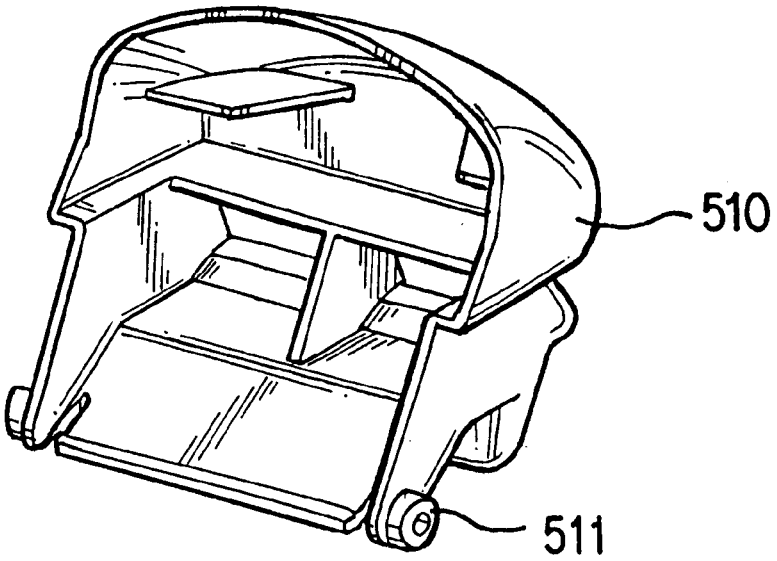
FIGS. 18A–B are perspective views of the highchair tray grip for the child support device shown in FIG. 1.
Figure 18B:
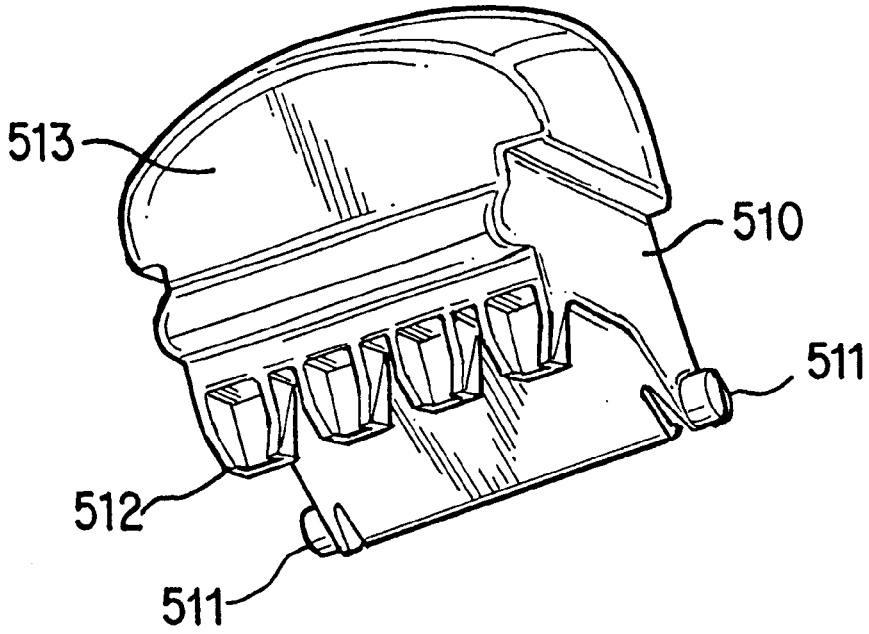

The highchair tray 500 can be adjustably attached to the seat 400 via a grip 510 that cooperates with corrugated indents 404 located on each side of the seat 400. As shown in FIGS. 17–18B, the highchair tray 500 can include pivoting attachment grips 510 located within a grip housing 501 on the bottom surface of the highchair tray 500. The grips 510 are pivotally secured within the grip housing 501 via post axes 511 that are located within grip throughholes 502. A number of ratchet teeth 512 provided on the grip 510 are designed to mate with the corrugated indents 402 located on either side of the seat 400, as seen in FIGS. 3 and 5. A spring (not shown) can be located between the grips 510 and the bottom surface of the highchair tray to bias the grip faces 513 towards an outward position and to bias the ratchet teeth 512 inward. In use, a person pushes the grip face 513 inward and attaches the highchair tray 500 to the seat 400. Once in place, the user releases the grip face 513 allowing the spring bias to rotate the ratchet teeth 512 back inward to lock onto a particular set of corrugated indents 402 located on the seat 400. Accordingly, the highchair tray 500 can be adjusted quickly and easily by depressing the grips 510 and moving the tray to a desired position with respect to the seat 400.

A swing tray 600, shown in FIG. 2, can be provided that is smaller and narrower than the highchair tray 500. The size of the swing tray 600 allows the swing tray to pass between the front left upper frame 111 and front right upper frame 112 when the swing arm 300 and seat 400 are swinging. The swing tray 600 can be secured to the seat 400 when the swing/highchair device is in the swing configuration by flexing the handles 601, seen in FIG. 16, outward and mating an indent/throughhole 602 on the side of the swing tray with an outdent 404 positioned on the seat 400 (see FIG. 3). Once the swing tray is in position, the handles 601 can be released to flex back to their original location and lock the swing tray 600 with respect to the seat 400. Ribs 603 can be provided in the rear surface of the swing tray 600 to increase the tray's strength and flexure characteristics.

Figure 20:
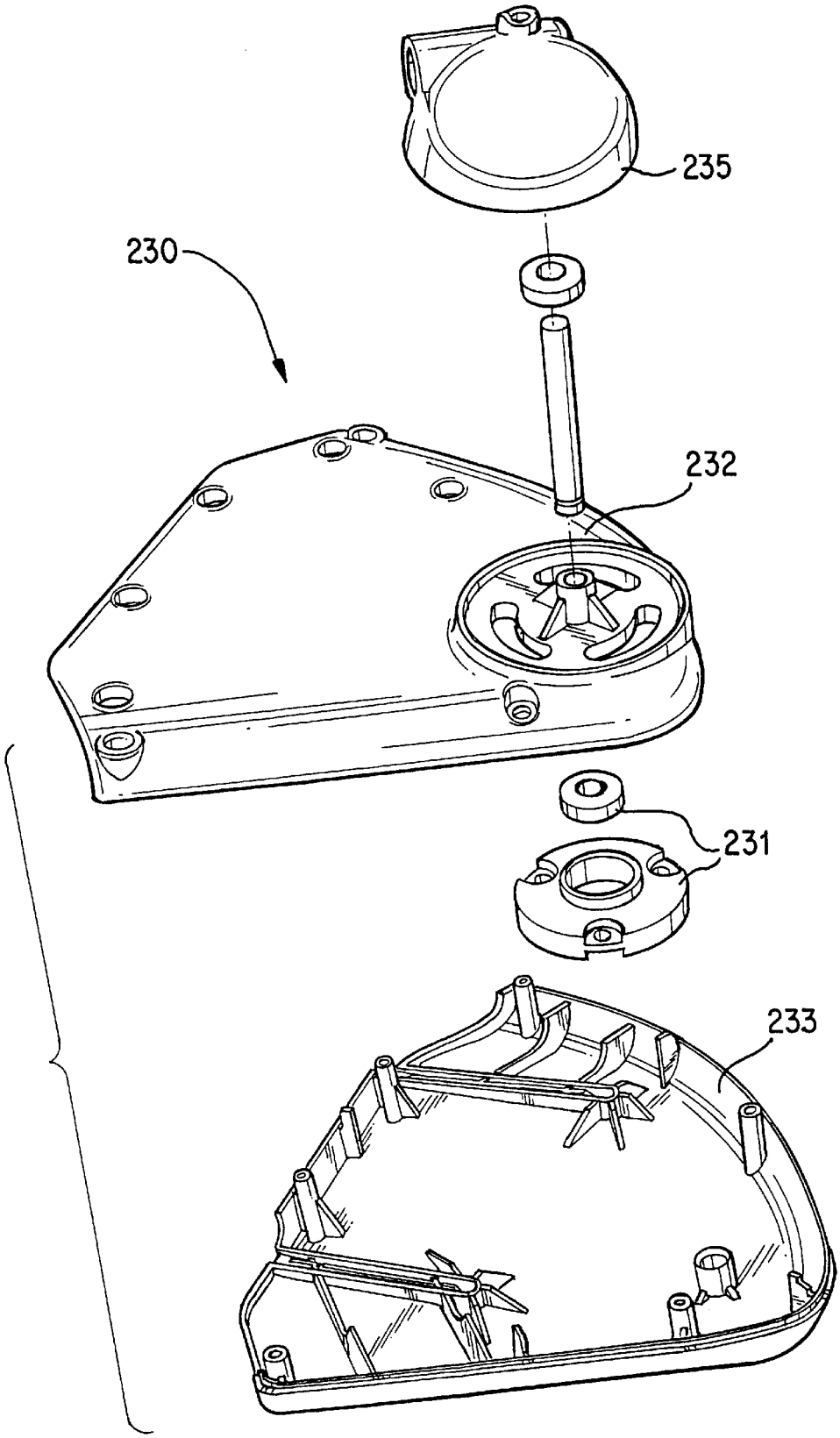
FIG. 20 is an exploded view of the upper frame joint with idler for the child support device shown in FIG. 1.

As shown in FIGS. 19 and 20, the upper frame joints 200 and 230 can include a motor structure and an idler structure, respectively. Upper frame joint 200 can include an outer housing 210, an inner housing 214 and a middle housing 212. A motor 204 attached to a flywheel 203 can be provided within the upper frame joint 200 and controlled by a PC board 202. The motor 204 acts in cooperation with a drive spring to drive lever arm 206 and pivot hub 250, and thus automatically operate the swing/highchair device.

Upper frame joint 230 can include an idler mechanism that is sandwiched between an inner housing 232 and an outer housing 233 and includes a thrust bearing 231.

Each of the upper frame joints 200 and 230 includes two pathways for inserting and locking the front and rear tubular frame members. Specifically, a front or rear right upper frame tube 112 or 122 can be inserted along slideway 209 in the upper frame joint 200. Once the frame 112 or 122 reaches the end of the slideway, a first button lock located in the frame tube 112 or 122 locks the end of the frame into the upper framejoint 200. The frame 112 or 122 can then be rotated, using the first button lock as a pivot point, to slide a second button lock (located at a lower position on the frame tube) along slideway 208. When the frame 112 or 122 is rotated into place, the second button lock will reach the end of slideway 208 and lock into a mating opening in the inner housing 214 to lock the frame in place.

Figure 21:
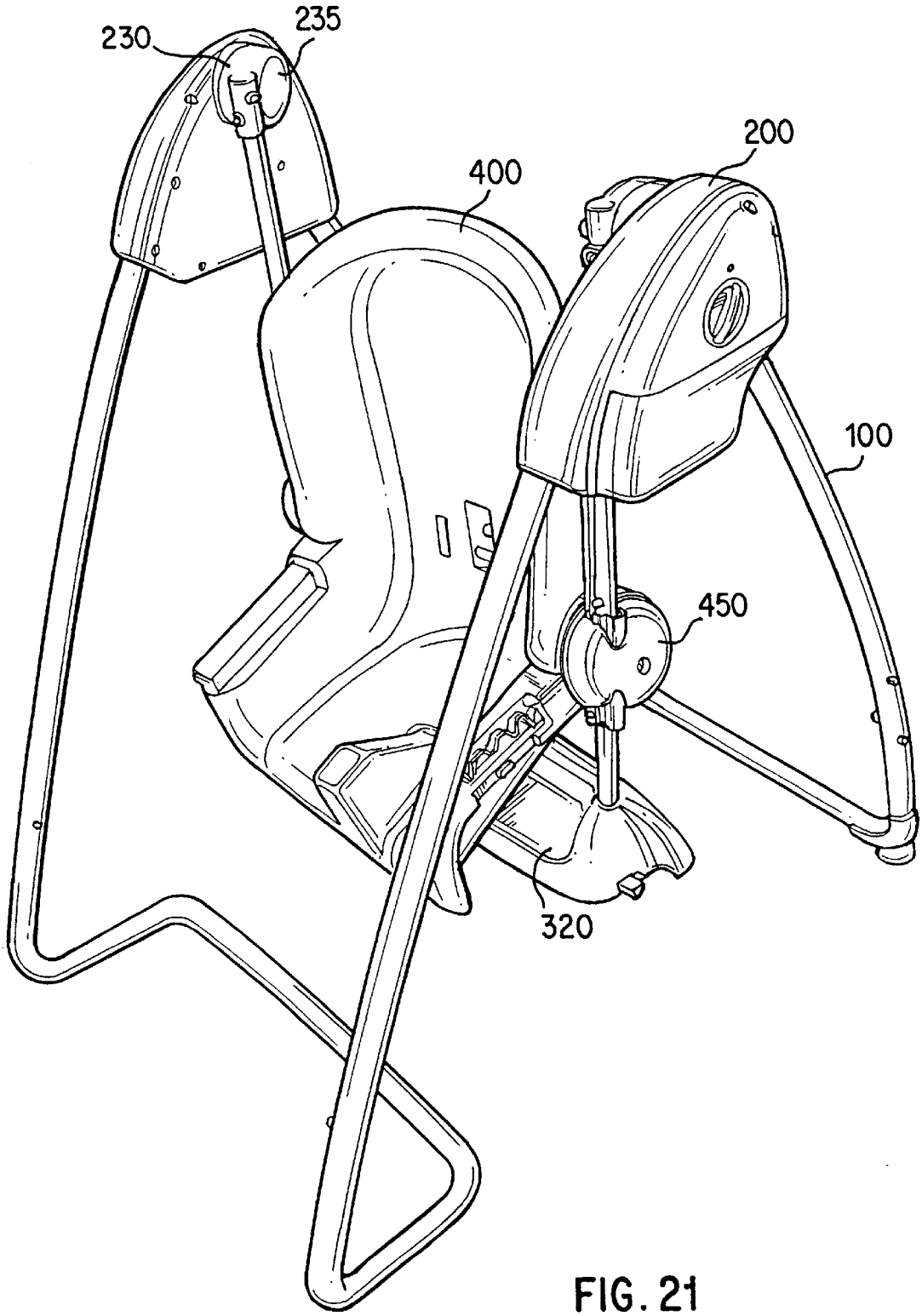
FIG. 21 is a perspective view of the child support device shown in FIG. 1 during conversion from the swing configuration to the highchair configuration.
Figure 22:
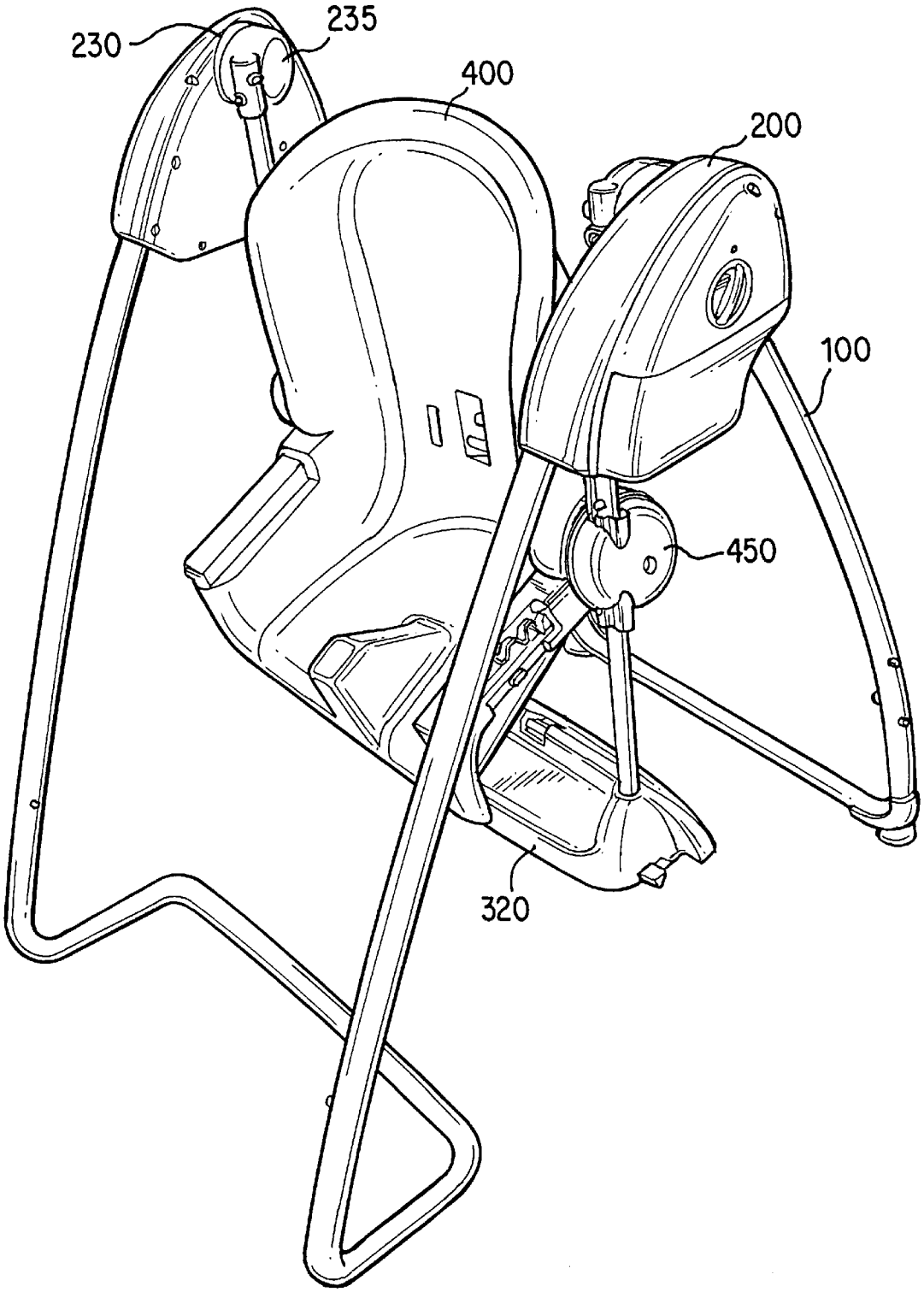
FIG. 22 is a perspective view of the child support device shown in FIG. 1 during conversion from the swing configuration to the highchair configuration.
Figure 23:
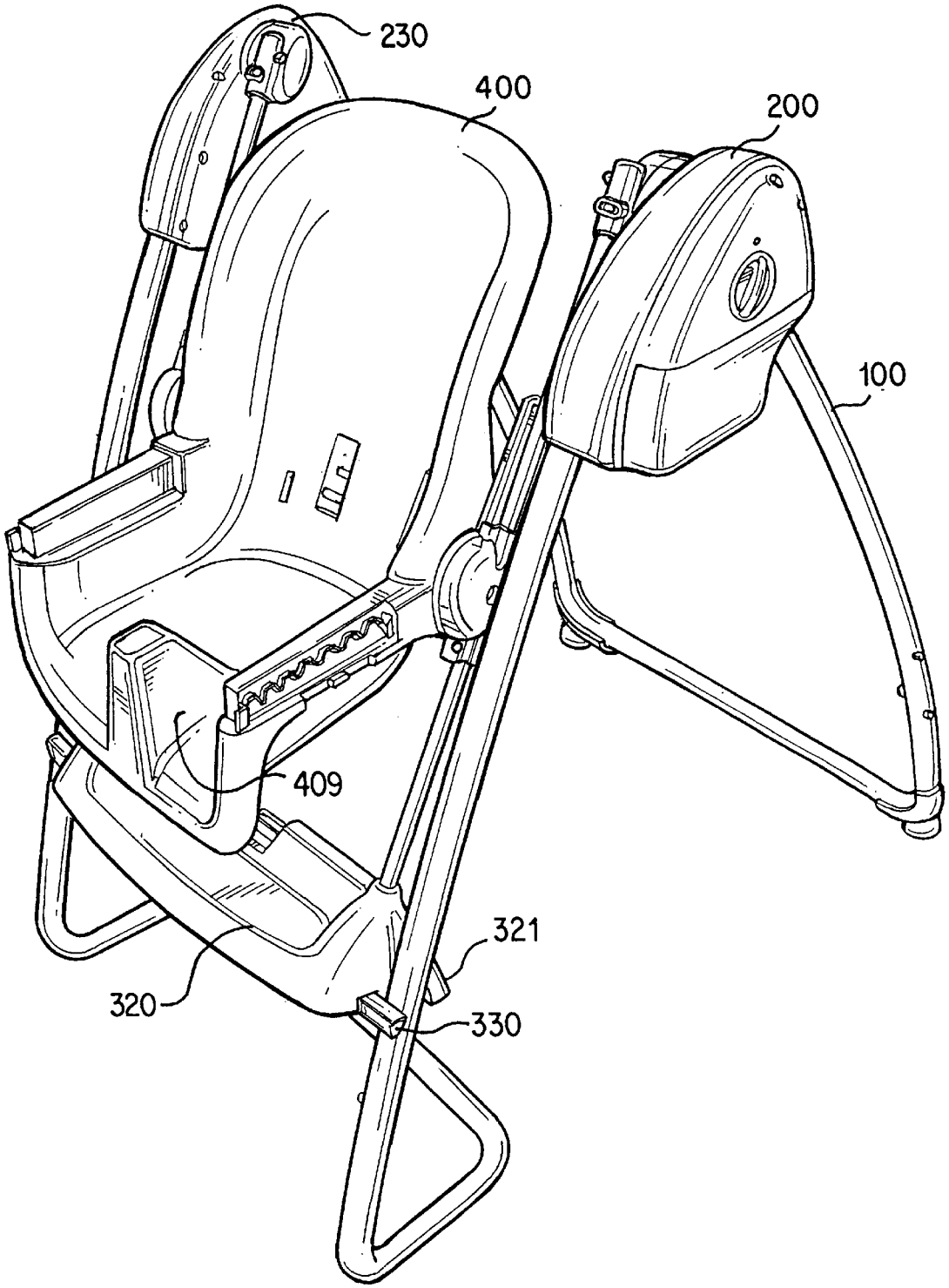
FIG. 23 is a perspective view of the child support device shown in FIG. 1 during conversion from the swing configuration to the highchair configuration.

A specific method for converting the swing/highchair device from a swing configuration to the highchair configuration will now be described with reference to FIGS. 21–23.

A user can first rotate the swing arm until the overrotation stops 321 are in contact with the frame 100. The post locks 331 should then be slid outward and away from the footrest so that both retractable posts 330 lock the frame between the posts 330 and the overrotation stops 321. Next, the user slides the seat 400 upwards along the vertical arms 301 until the stop surfaces 458 of the pivot caps 451 come into contact with button locks 701. The user must manually depress the button locks 701 to permit further upward movement of the seat 400 along the vertical arms 301 and to release the seat lock notches 401 from the mating surfaces 323 on the footrest 320. Once the notches 401 and mating surfaces 323 are separated, the seat 400 can be rotated about the pivot 450 until the keyways 461 align with the rails 302 on the vertical arms 301. The seat 400 can be slid upwardly until the button openings 456 in the pivot cap reach button locks 702 to automatically lock the seat 400 in the lower highchair position. If the upper highchair position is desired, button locks 702 must be manually depressed and the seat slid upwardly until button openings 456 reach button locks 703. Button locks 704 prevent further upward movement of the swing 400 and keep the rails 302 within the keyways 461 to rotationally lock the seat 400 with respect to the frame 100 and the swing arm 400. A highchair tray 500 can be attached to the seat 400 and the device can be operated as a typical highchair.

Figure 24B:
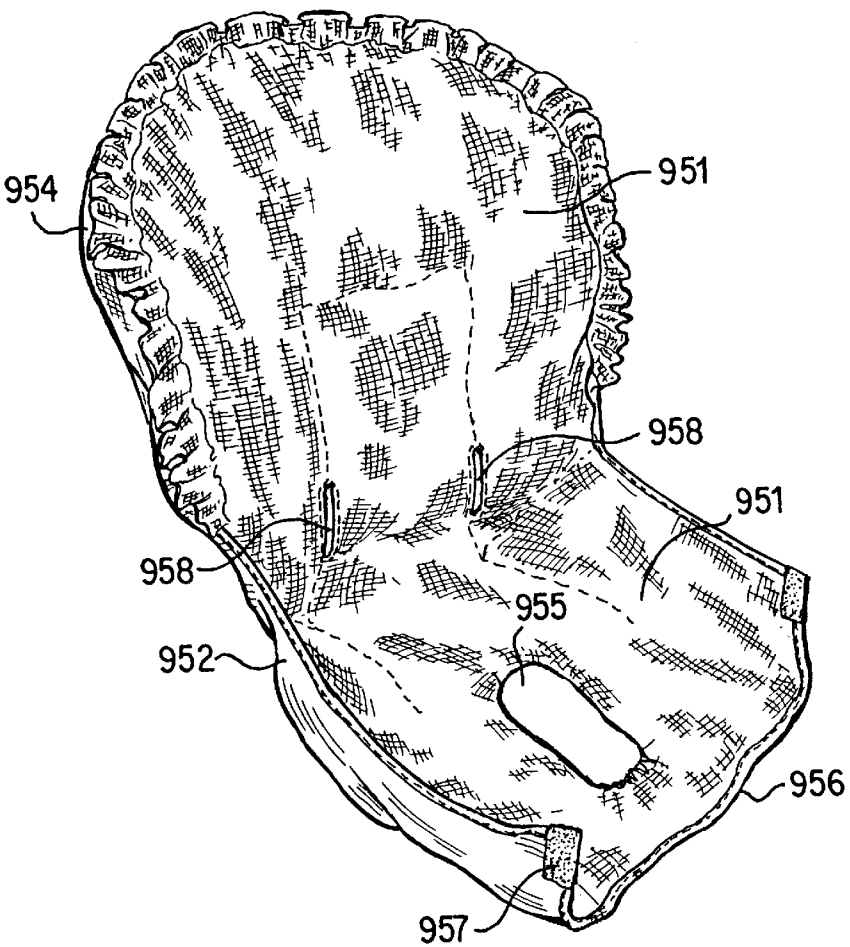
FIGS. 24A–C are back, front and reversed perspective views, respectively, of a reversible softgoods support made in accordance with the principles of the invention.
Figure 24A:
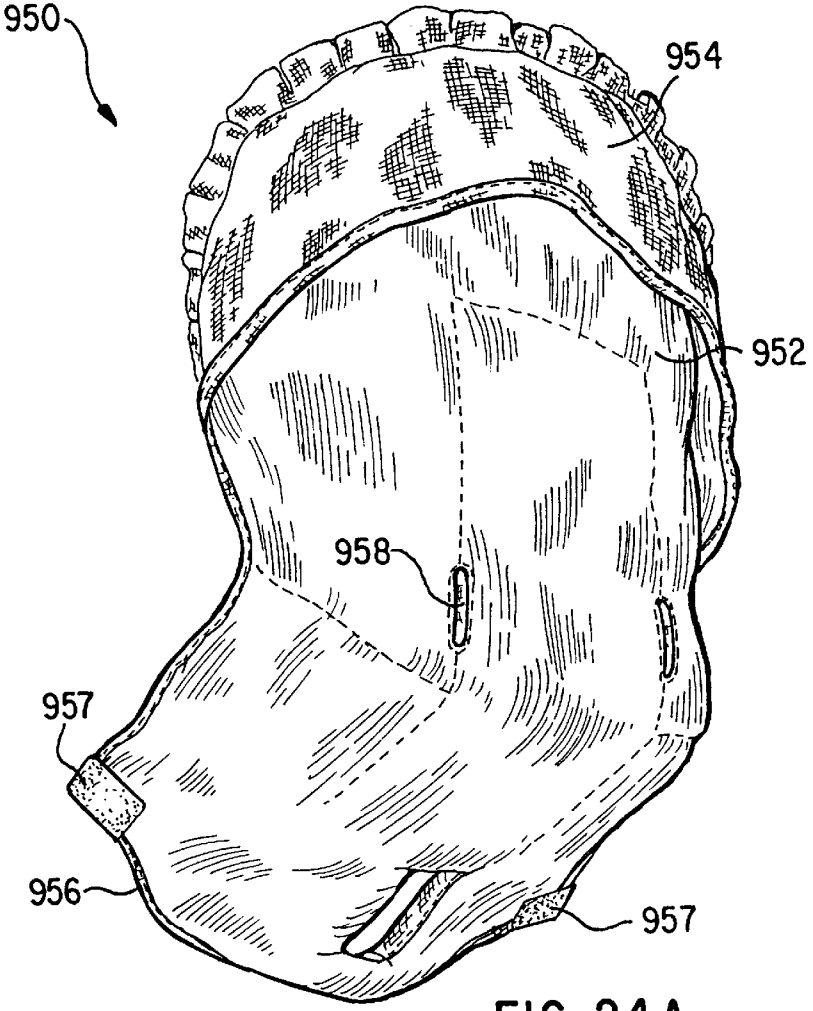
Figure 24C:
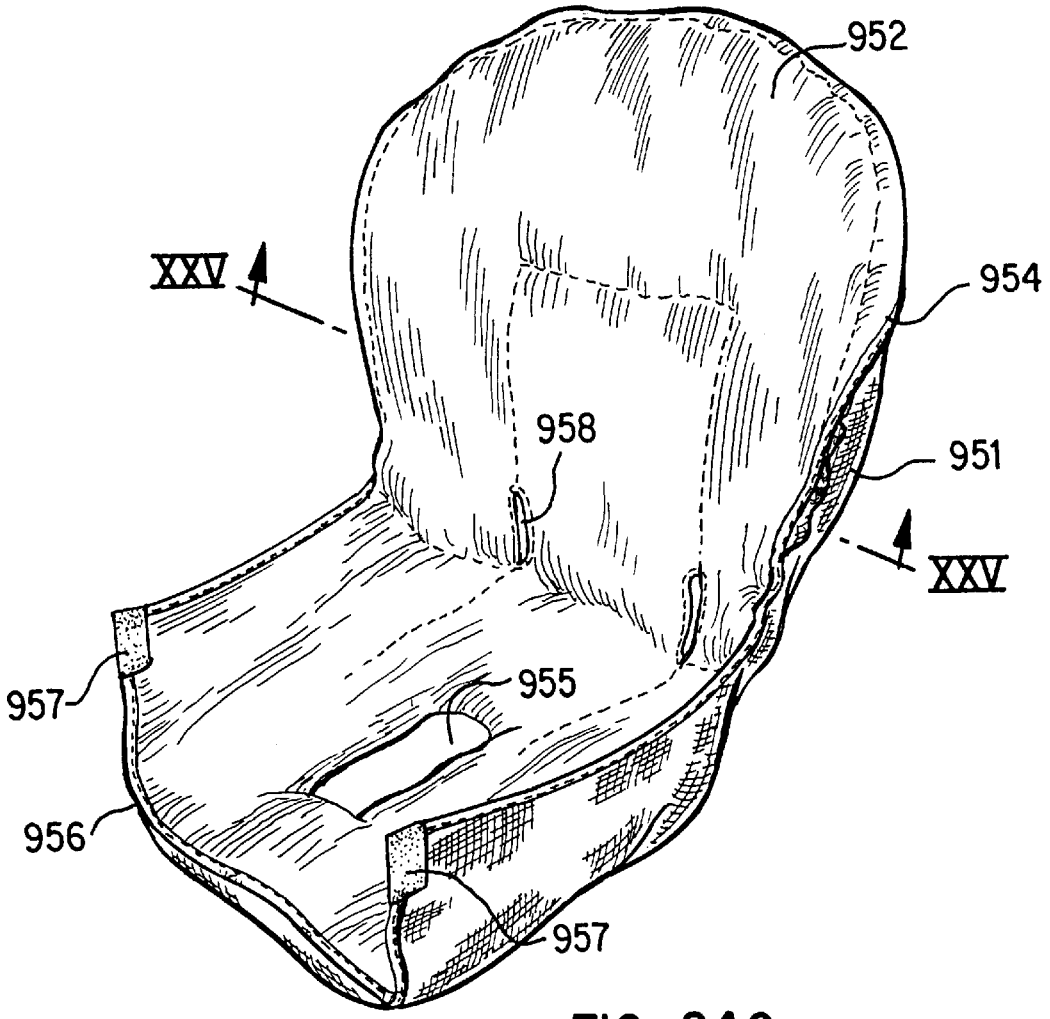
Figure 25:
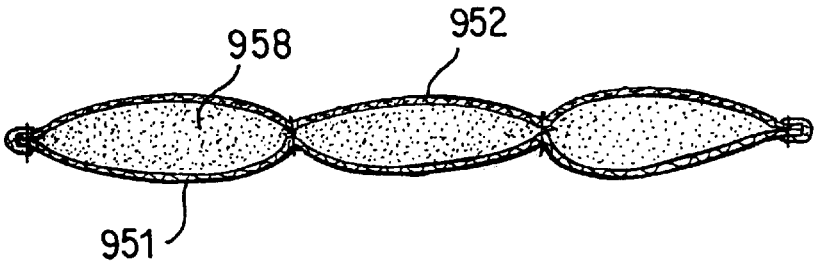
FIG. 25 is a cross-sectional view taken along line XXV–XXV of FIG. 24C.

As shown in FIGS. 24A–25, a reversible softgoods device 950 can be provided that includes a first layer 951 that is preferably made from a soft material such as cotton, polyester or other fabric. A second layer 952 is attached to the first layer 951 and is preferably made from a material that resists fluids and stains, such as polypropylene, coated vinyl, coated cotton, etc. The first layer 951 and second layer 952 can be substantially identical in shape and attached about their periphery to contain a soft padding material 953 such as cotton, foam or other sponge like materials. The softgoods device 950 should be shaped to easily fit within the seat of the swing/highchair device and include beltways 958 for passage of a safety belt. An opening in the base of the softgoods device can be provided to allow a child positioning structure 409 to extend through the reversible softgoods device 950 when located on the seat 400. A hood 954 can be provided on the seat back portion of the second layer 952 to secure the back portion of the softgoods device to the back of the seat 400. An elastic band 956 can be incorporated into the base of the seat portion of the softgoods device 950 to fit the base of the softgoods device snugly to the base of the seat 400. In addition, hook and loop tabs 957 can be provided at either corner of the base of the softgoods device 950 to further secure the device to the seat 400.

In operation, a user can fit the reversible softgoods device onto the seat 400 with the second layer 952 facing the seat 400 when the swing/highchair device is in the swing configuration. The hood 954 can be snugly fit over the back of the seat 400 while the elastic band 956 and hook and loop tabs 957 are attached to the base of the seat 400. After the swing/highchair device is converted to the highchair configuration, the reversible softgoods device 950 can be flipped over such that the first layer 951 faces the back of the seat 400 and the second layer 952 is outwardly exposed. The hood 954 can be inverted about the upper portion of the softgoods device 950 to act in the same manner when attached to the back of the seat 400 with the first layer 951 facing the seat back. The lower seat portion of softgoods device can be attached to the seat 400 by attaching the elastic band 956 and hook and loop tabs 957 over the base of the seat 400. The outwardly exposed second layer 952 provides a durable, stain resistant surface that can endure the numerous spills and food droppings that often occur when a child is in a highchair.

Although the invention has been described with specific reference to the enclosed drawings, it should be understood that many variations can be made to the disclosed structures without departing from the scope and spirit of the invention. For example, the method for converting the device from the swing configuration to the highchair configuration can be accomplished in many different ways and sequences. It is possible that the seat never be required to slide along the vertical arms at all and that the vertical arms with seat attached be pulled through the pivot hubs to a highchair configuration. It is also possible that the overrotation stops could be incorporated into the hubs and/or inner structure of the upper frame joints. In addition, a variety of different locks could be used in place of the disclosed button locks, swing locks and seat locks, including screw fasteners, ratcheting fastening structures, pin locks, clamps and other locking mechanisms. The material of the frame is preferably metal tubing, but can conceivably be made from plastic and other rigid materials.

The softgoods device is disclosed as used with the swing/highchair device, but it is contemplated that the softgoods device be used in many different types of child support devices to provide the ability to quickly and easily change from a comfortable padding type of softgoods device to a fluid and stain resistant version of the same softgoods device by simply flipping the softgoods device over.

What is claimed is:

1. A method for converting a support device between a highchair configuration and a swing configuration, comprising the steps of:

providing a frame, a swing arm having a distal portion and a proximal portion rotatably attached to said frame, and a support structure movably located on said swing arm, moving the support structure between a first position in which the support structure is located at the distal portion of the swing arm and the support device is in the swing configuration, and a second position in which the support structure is located at the proximal portion of the swing arm and the support device is in the highchair configuration.

2. The method of claim 1, further comprising the step of:

locking said swing arm to prevent rotation relative to said frame when the support device is in the highchair configuration.

3. The method of claim 1, further comprising the step of:

locking said support structure to prevent rotation relative to said swing arm when the support device is in the highchair configuration.

4. The method of claim 1, further comprising the step of:

locking said support structure to prevent movement relative to said swing arm when said support device is configured in the swing configuration.

5. The method of claim 1, further comprising the steps of:

providing a highchair tray; and securing said highchair tray to said support structure when the support device is in the highchair configuration.

6. The method of claim 5, further comprising the steps of:

providing a swing tray; and securing said swing tray to said support structure when the support device is in the swing configuration.

7. The method of claim 1, further comprising the steps of:

providing a swinging motor for swinging said swing arm; and swinging said swing arm with said swing motor.

8. The method of claim 7, wherein said swinging motor is an electric motor.

9. A method for converting a support device from a swing configuration to a highchair configuration, comprising the steps of:

providing a frame, a swing arm having a distal portion and a proximal portion and the swing arm being rotatably coupled to the frame, a support structure coupled to the swing arm in the swing configuration and the support structure being repositionable relative to the swing arm, and a first coupling disposed on one of the frame, the swing arm and the support structure;

positioning the support structure from a swing position to a highchair position, the swing position corresponding to the support structure being located nearer the distal portion than the proximal portion and the highchair position corresponding to the support structure being located nearer the proximal portion than the distal portion;

fixedly coupling the support structure to the swing arm, the support structure including a second coupling adapted for engagement with the swing arm when the support structure is in the highchair position, wherein said fixedly coupling the support structure to the swing arm step includes engaging the second coupling with the swing arm; and engaging the first coupling so as to secure the support structure to the frame, wherein the support structure being secured to the frame prevents rotation of the support structure relative to the frame when the support device is in the highchair configuration.

10. The method of claim 9, wherein a notch is located on one of the swing arm and the support structure and a notch mating surface is located on the other of the swing arm and the support structure, the swing position further corresponding to the notch being mated with the notch mating surface so as to prevent rotation of the support structure relative to the swing arm;

wherein said positioning step further includes removing the notch from the notch mating surface so as to permit relative rotation between the support structure and the swing arm.

11. The method of claim 9, wherein a lock extension is located on one of the swing arm and the support structure and a lock mating surface is located on the other of the swing arm and the support structure;

wherein said positioning step further includes mating the lock extension with the lock mating surface so as to prevent rotation of the support structure relative to the swing arm.

12. The method of claim 11, wherein the lock extension is a rail and the lock mating surface is a keyway and wherein said step of mating the lock extension with the lock mating surface includes aligning the keyway with the rail and sliding the rail along the keyway.

13. The method of claim 9, wherein the first coupling is a swing lock disposed on one of the support structure and the swing arm, wherein said securing step further includes engaging the swing lock with the frame so as to prevent rotation of the support structure relative to the frame.

14. The method of claim 13, wherein the swing lock is configurable between a deployed position and stowed position and wherein said engaging the swing lock with the frame includes the steps of rotating the swing arm so as to position the swing lock in operative proximity to the frame;

and moving the swing lock from the stowed to the deployed position so as to enable engagement of the swing lock with the frame.

15. The method of claim 13, wherein the swing lock includes a retractable post disposed on the swing arm.

16. The method of claim 13, wherein said providing step includes providing a frame with an elongate leg the elongate leg having a leg portion, and wherein the swing lock includes a first engagement surface and a second engagement surface, wherein said engaging the swing lock with the frame step includes positioning the leg portion between the first engagement surface and the second engagement surface so as to prevent rotation of the support structure relative to the frame.

17. The method of claim 9, wherein when the support device is in the swing configuration, the support structure is inclined at a first angle relative to the swing arm;

wherein said positioning the support structure from the swing position to the highchair position step further includes rotating the support structure relative to the swing arm so as to incline the support structure at a second angle relative to the swing arm, wherein the second angle is less than the first angle.

18. The method of claim 17, wherein the support device is supported on a support surface, wherein the support structure includes a seat, and wherein the second angle relative to the swing arm further corresponds to the seat being positioned as a generally upright seat relative to the support surface, and wherein the support structure inclined at the first angle further corresponds to the seat being reclined relative to the support surface so that the seat is orientated in a position suitable for swing use.

19. The method of claim 9, wherein said providing step includes providing a rigid swing arm, the rigid swing arm having a longitudinal axis extending between the distal portion and the proximal portion.

20. The method of claim 19, wherein said positioning the support structure from a highchair position to a swing position includes sliding the support structure along the longitudinal axis of the swing arm so as to position the support structure nearer the proximal end than the distal end.

21. The method of claim 20, wherein the support structure includes a housing connected to a seat portion, the housing including a slot for slidably receiving the swing arm, and the first coupling is an engagement member positionable between an extended and retracted position, the engagement member being disposed on one of the housing and the swing arm and the engagement member being engageable with an opening disposed on the other of the housing and the swing arm;

said sliding the support structure along the longitudinal axis of the swing arm further including sliding the swing arm through the slot of the housing; and said fixedly coupling the support structure to the swing arm step includes engaging the engagement member with the opening.

22. The method of claim 9, wherein said providing step further includes providing a U-shaped swing arm having a U-shaped portion extending between first and second terminal ends, wherein the proximal portion corresponds to the first and second terminal ends and the distal portion corresponds to the U-shaped portion.

23. The method of claim 9, wherein said providing step includes providing an electric motor, the electric motor being adapted for inducing swinging motion to the support device.

24. The method of claim 9, wherein the first coupling includes a spring biased button disposed on the swing arm, wherein said fixedly coupling the support structure to the swing arm includes engaging the spring biased button with the support structure.

* * * * *